US006845834B2

(12) United States Patent
Hatanaka

(10) Patent No.: US 6,845,834 B2
(45) Date of Patent: Jan. 25, 2005

(54) MOVABLE RACK SYSTEM

(75) Inventor: Joji Hatanaka, Shiga (JP)

(73) Assignee: Daifuku Co., Ltd. (JP)

( * ) Notice: Subject to any disclaimer, the term of this patent is extended or adjusted under 35 U.S.C. 154(b) by 185 days.

(21) Appl. No.: 10/086,045

(22) Filed: Feb. 28, 2002

(65) Prior Publication Data

US 2002/0131849 A1 Sep. 19, 2002

(30) Foreign Application Priority Data

Mar. 19, 2001 (JP) ..... 2001-077355

(51) Int. Cl.[7] ..... A47B 53/00
(52) U.S. Cl. ..... 180/167; 211/1.57
(58) Field of Search ..... 414/266, 267, 414/281, 331.01, 331.06, 807; 211/1.51, 1.57, 162; 312/198, 201; 180/167–169, 6.2, 6.48, 6.5

(56) References Cited

U.S. PATENT DOCUMENTS 4,039,040 A * 8/1977 Spears et al. ..... 104/288
4,424,875 A * 1/1984 Yoshida ..... 180/168
5,333,983 A * 8/1994 Hatouchi et al. ..... 414/331.06
5,842,585 A * 12/1998 Hollander ..... 211/162

FOREIGN PATENT DOCUMENTS

JP 9-278124 10/1997
JP 10215958 A 8/1998
JP 11046888 A 2/1999
JP 2000044019 A 2/2000
JP 2000142922 A 5/2000
JP 2000142923 A 5/2000
JP 2000302209 A 10/2000
JP 2000313504 A 11/2000
JP 2001048314 A 2/2001

* cited by examiner

*Primary Examiner*—Dean J. Kramer
(74) *Attorney, Agent, or Firm*—Kusner & Jaffe

(57) ABSTRACT

Pulse encoders (21) are linked to motors (16) in driven travel support devices positioned in the opposite outside portions of a movable rack travel path (trackless) in a transverse direction to the travel path, and a movable rack controller (41) is provided for controlling drive rotation amounts of the motors (16), based on pulse signals from pulse encoders (21). That controller (41) finds travel distances of the driven travel support devices by counting the pulses from the pulse encoders (21), and, when a difference occurs in pulse counts, the controller finds predicted travel distances for the driven travel support devices expected in a certain period of time, based on the travel distances, and performs a movable rack deviation (inclination) correcting control to control speeds (drive rotation amounts) of the motors (16) to eliminate a deviation between the predicted travel distances. The movable rack system thus provided allows a vehicle to travel through a work corridor in one direction, and a group of movable racks to travel in a perpendicular attitude relative to a travel path.

23 Claims, 14 Drawing Sheets

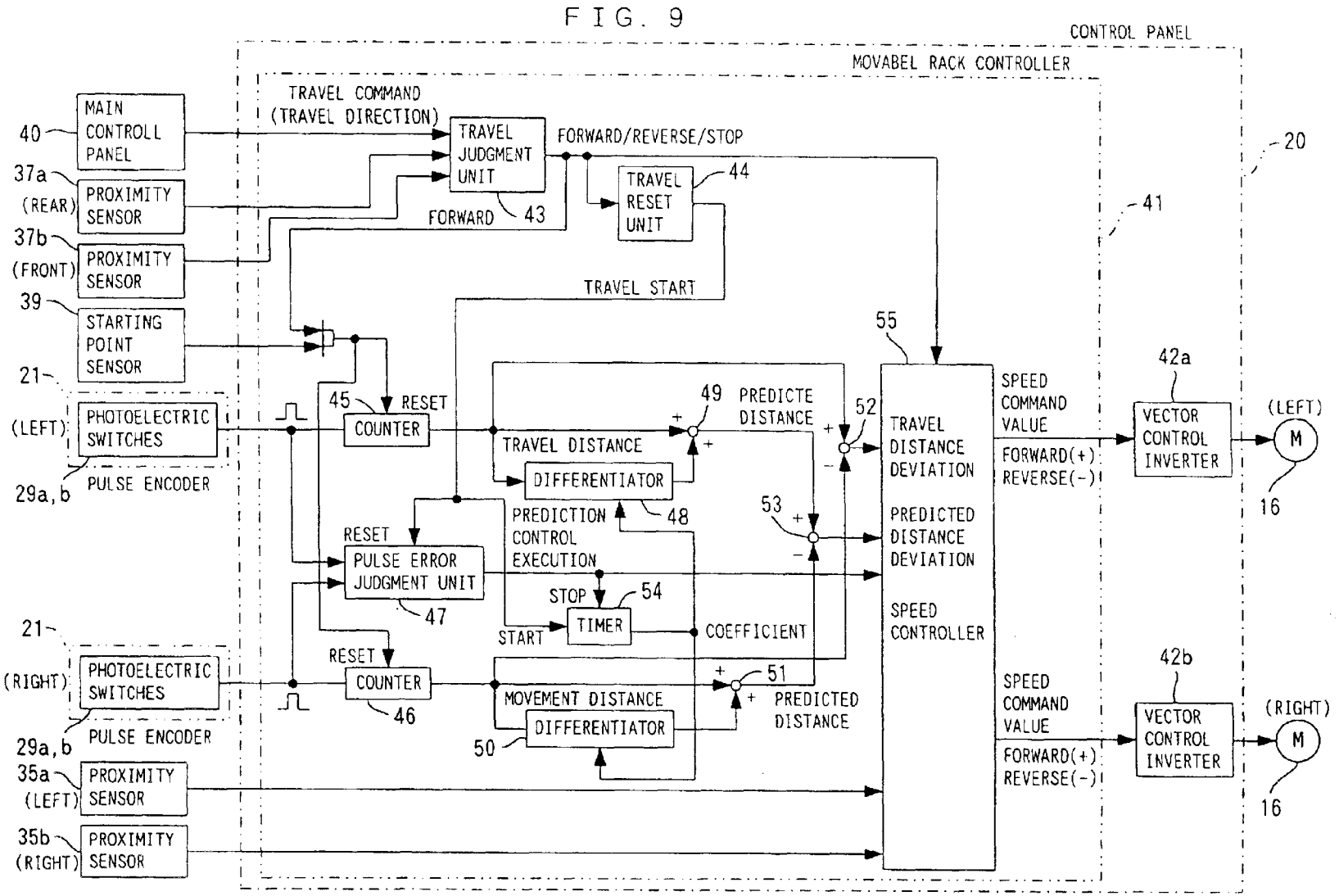
FIG. 9
CONTROL PANEL
20
MOVABEL RACK CONTROLLER
41
(LEFT)
M
16
(RIGHT)
M
16
42a
VECTOR CONTROL INVERTER
42b
VECTOR CONTROL INVERTER
SPEED COMMAND VALUE
FORWARD(+) REVERSE(-)
SPEED COMMAND VALUE
FORWARD(+) REVERSE(-)
55
TRAVEL DISTANCE DEVIATION
PREDICTED DISTANCE DEVIATION
SPEED CONTROLLER
52
53
51
PREDICTE DISTANCE
PREDICTED DISTANCE
COEFFICIENT
49
48
54
44
TRAVEL RESET UNIT
TRAVEL START
FORWARD/REVERSE/STOP
TRAVEL DISTANCE
DIFFERENTIATOR
PREDICTION CONTROL EXECUTION
STOP
TIMER
START
MOVEMENT DISTANCE
DIFFERENTIATOR
50
43
TRAVEL JUDGMENT UNIT
FORWARD
TRAVEL COMMAND (TRAVEL DIRECTION)
RESET
COUNTER
45
RESET
PULSE ERROR JUDGMENT UNIT
47
RESET
COUNTER
46
MAIN CONTROLL PANEL
40
PROXIMITY SENSOR
37a
(REAR)
PROXIMITY SENSOR
37b
(FRONT)
STARTING POINT SENSOR
39
PHOTOELECTRIC SWITCHES
PULSE ENCODER
21
(LEFT)
29a, b
PHOTOELECTRIC SWITCHES
PULSE ENCODER
21
(RIGHT)
29a, b
PROXIMITY SENSOR
35a
(LEFT)
PROXIMITY SENSOR
35b
(RIGHT)

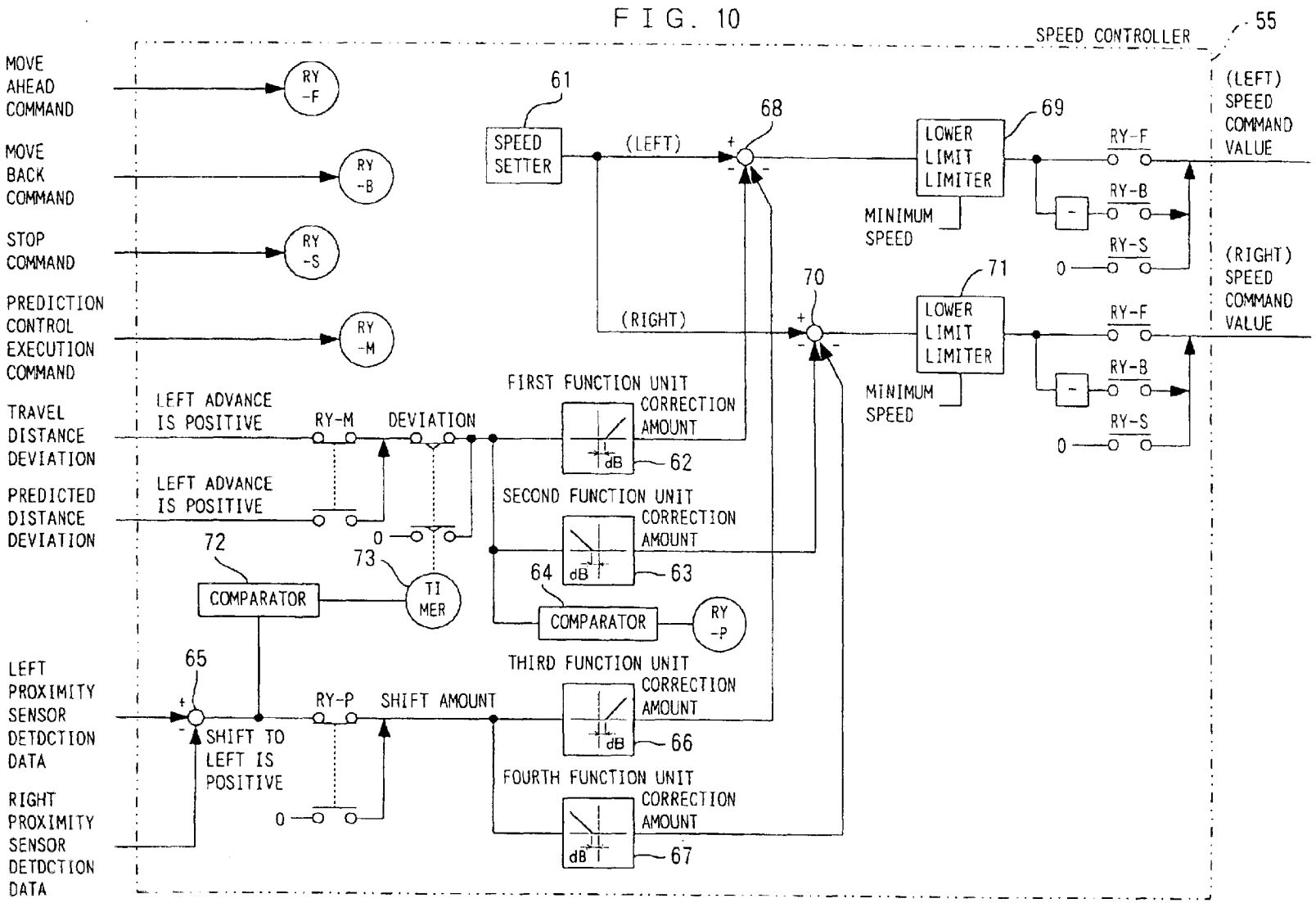
FIG. 10
SPEED CONTROLLER
55
(LEFT) SPEED COMMAND VALUE
(RIGHT) SPEED COMMAND VALUE
RY-F
RY-B
RY-S
0
LOWER LIMIT LIMITER
MINIMUM SPEED
69
71
70
68
(LEFT)
(RIGHT)
61
SPEED SETTER
FIRST FUNCTION UNIT CORRECTION AMOUNT
SECOND FUNCTION UNIT CORRECTION AMOUNT
THIRD FUNCTION UNIT CORRECTION AMOUNT
FOURTH FUNCTION UNIT CORRECTION AMOUNT
62
63
66
67
dB
RY -P
COMPARATOR
64
DEVIATION
SHIFT AMOUNT
TIMER
73
RY-M
RY-P
RY -F
RY -B
RY -S
RY -M
LEFT ADVANCE IS POSITIVE
LEFT ADVANCE IS POSITIVE
72
COMPARATOR
SHIFT TO LEFT IS POSITIVE
65
MOVE AHEAD COMMAND
MOVE BACK COMMAND
STOP COMMAND
PREDICTION CONTROL EXECUTION COMMAND
TRAVEL DISTANCE DEVIATION
PREDICTED DISTANCE DEVIATION
LEFT PROXIMITY SENSOR DETDCTION DATA
RIGHT PROXIMITY SENSOR DETDCTION DATA

MOVABLE RACK SYSTEM

FIELD OF THE INVENTION

This invention relates to movable rack system installed in confined spaces inside warehouses, for example, that is, to movable rack system in which a plurality of moving racks are deployed that travel freely back and forth along travel paths by travel support devices.

BACKGROUND OF THE INVENTION

One of known movable rack systems is configured by a plurality of trackless moving racks. Each of these moving racks includes a plurality of travel wheels configured so that they are free to move mutually closer together or farther apart, deployed to be lined up on a floor surface. Also, in order to give the moving racks the property of direct advance, guide members deployed at one end of each of the moving racks in the long direction are latched by a side rail, deployed on the floor surface, long in the direction of movement.

At either end of the moving rack, in the long direction thereof, position detection means capable of detecting travel distances are provided, and wheels (drive wheels) linked to drive motors are deployed among the plurality of travel wheels. Then, when the detected values obtained by the position detection means at the two ends are compared and a speed difference has been found, based thereon, an output difference is imparted to the drive wheels at either end, in a direction that cancels the speed difference, whereupon the configuration is such that the long direction of the moving rack becomes perpendicular to the side rail.

With the configuration of the known movable rack system described above, however, the following problems arise.

That is, by the side rail being deployed on the floor surface, forklifts and other vehicles ride over the side rail, and the space (work corridor) cannot be traveled through in one direction, as a consequence whereof operations by forklift and the like become subject to restriction.

SUMMARY OF THE INVENTION

It is an object of the present invention to provide a movable rack system that can solve the problems, whereby the vehicle can travel to pass through a work corridor in one direction, and a group of movable racks can travel in an attitude perpendicular to the travel path.

In order to attain that object, the present invention is a movable rack system comprising a plurality of movable racks that travel freely back and forth along a travel path while being supported by a plurality of travel support devices, characterized in that out of the plurality of travel support devices, two travel support devices are positioned in opposite outside portions in a transverse direction to the travel path, each of the travel support devices including a rotation drive means and being a driven travel support device, and in that each of the movable racks includes travel amount detection means respectively detecting travel amounts of the driven travel support devices positioned in the opposite outside portions, and a control means for controlling drive rotation amounts of the rotation drive means, based on detection results by the travel amount detection means. The control means performs a movable rack attitude correcting control by using predicted values for the travel amounts of the driven travel support devices, when a deviation occurs in the travel amounts of the driven travel support devices respectively detected by the travel amount detection devices, so that the drive rotation amounts of the rotation drive means are correctively controlled to eliminate the deviation between the predicted values.

According to the foregoing configuration, when movable rack groups each comprising a plurality of movable racks are caused to travel along a travel path, a work corridor can be formed in front of a target movable rack. That is, for example, by causing a vehicle such as a forklift to travel inside the work corridor, loading and unloading of goods can be performed from the work corridor side. At that time, because no side rails are arranged unlike the known example, vehicles like forklifts can freely travel to pass through the work corridor.

In the travel of the movable rack group along the travel path, a pair of rotation drive means are activated to drive the respective driven travel support devices to turn to apply a travel force to the movable racks. As a result, the travel can be performed while the remaining travel support devices are allowed to effect following turning (free turning). Further, if the travel of the movable racks is not done in a condition where the movable racks are maintained in a perpendicular attitude with respect to the travel path, but is done in a condition where the movable racks are in an inclined attitude with one side portion moving ahead and the other side portion lagging behind, the drive amounts are detected by the respective drive amount detection means, and a movable rack attitude correcting control is performed, based on these detection results, by the control means by using predicted values for the travel amounts, thereby controlling the drive rotation amounts of the rotation drive means. Thus, a difference in drive rotation amount occurs between the pair of rotation drive means, whereby the inclined attitude described above can be gradually corrected and cancelled.

BRIEF DESCRIPTION OF THE DRAWINGS

FIG. 9 is a control block diagram for the movable rack in the same movable rack system;

FIG. 10 is a block diagram of a speed control unit in a movable rack controller in the same movable rack system;

DESCRIPTION OF THE PREFERRED EMBODIMENTS

[First Embodiment]

Figure 1:
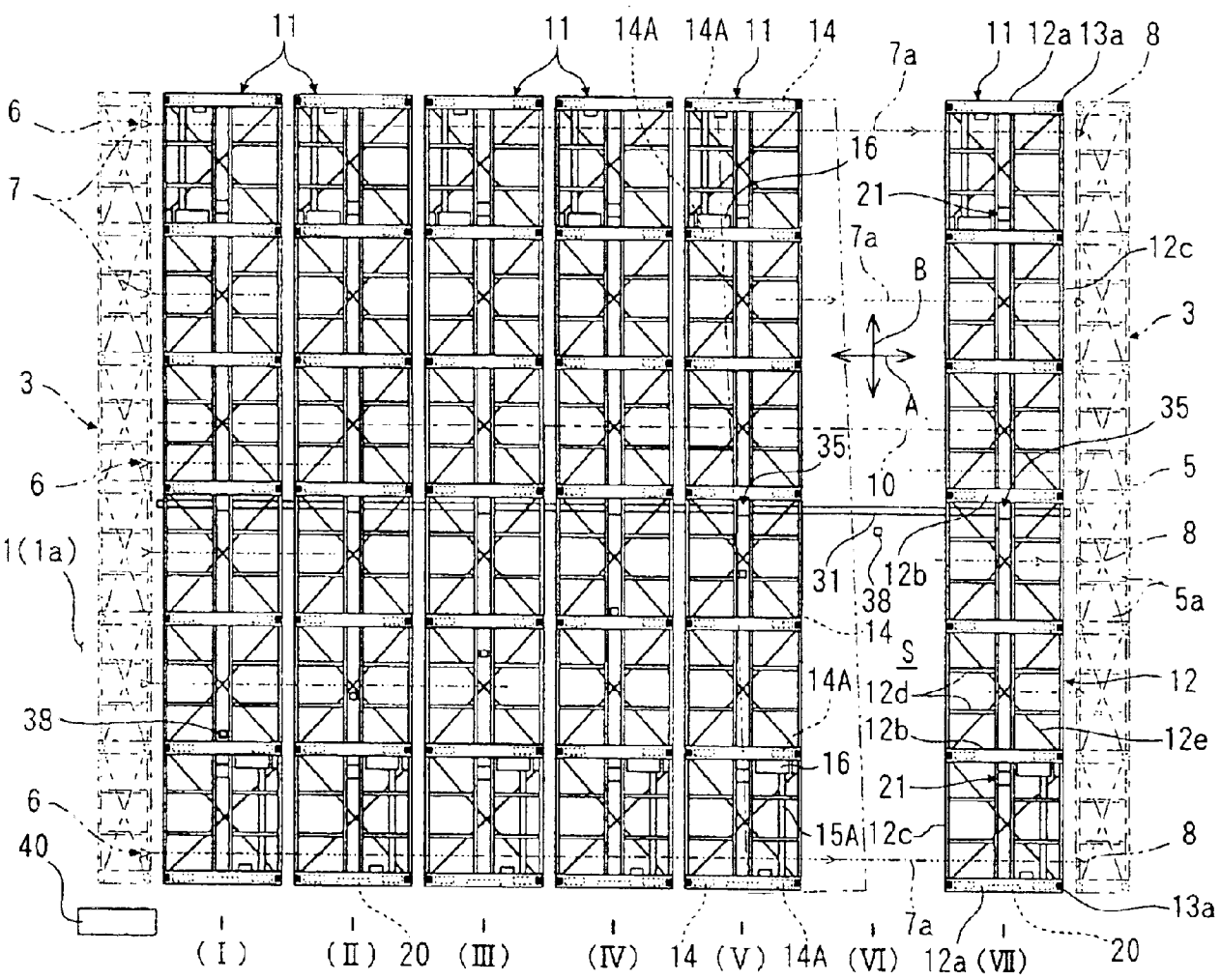
FIG. 1 is a plan of a movable rack system according to a first embodiment of the present invention.

A first embodiment of the present invention is described below with reference to FIG. 1 to 11.

As diagrammed in FIG. 1 and FIG. 2, movable racks 11 are deployed in a plurality to travel freely back and forth along a travel path 10 by travel support devices (hereinafter described). These movable racks 11 are each configured by a lower frame unit 12, and a rack unit 13 installed on that lower frame unit 12.

As diagrammed in FIGS. 1, 2, 4, and 5, the lower frame unit 12 is configured in a rectangular frame shape by lateral lower frames 12*a* positioned on the left and right sides relative to a travel path direction (fore and aft direction) of the movable rack 11, intermediate lower frames 12*b* positioned at five places (multiple places) on the inside, linking members 12*c* linking between those lateral lower frames 12*a* and intermediate lower frames 12*b* in a traverse direction (left and right direction) B to the travel path direction, cross members 12*d* in the fore and aft direction deployed at multiple places between the linking members 12*c*, and a plurality of braces 12*e* and the like.

The lateral lower frames 12*a* and intermediate lower frames 12*b*, moreover, are respectively formed in a gate-like member shape, open at the lower surface, by a pair of side plates and an upper plate deployed in a linking manner between the upper edges of the two side plates. And the linking members 12*c* and cross members 12*d* are such that the cross-sections thereof are formed in a rectangular cylindrical member shape.

The rack unit 13 is formed in a framework shape by trusses 13*a*, beams 13*b*, sub-beams 13*c*, and braces 13*d* and the like erected up from the lateral lower frames 12*a* and intermediate lower frames 12*b*, whereupon a plurality of section accommodating spaces 13*e* that are open in the travel path direction A are formed in the fore and aft direction and transverse direction B. The uppermost level of section accommodating spaces 13*e* are open also toward the top.

As diagrammed in FIGS. 1, 4, 5, and 8, provided inside the lateral lower frames 12*a* and intermediate lower frames 12*b*, respectively, are pairs of fore and aft travel wheels 14 (constituting one example of travel support devices) via wheel shafts 15. These travel wheels 14 are configured by inside wheel units 14*a* made of metal and outside ring units 14*b* made of hard urethane rubber, configured so that they can turn freely on a floor surface 1*a* of a floor 1 made of concrete, for example, by the outside ring units 14*b*. That is, the travel wheels 14 are deployed at seven places (multiple places) in the transverse direction B to the travel path 10 and at two places (multiple places) in the travel path direction A, respectively.

The travel support devices positioned in opposite outside portions in the transverse direction B to the travel path 10 are configured as driven travel support devices provided respectively with rotation drive means. That is, of the groups of travel wheels 14 supported by the lateral lower frames 12*a* that are the two lateral portions in the transverse direction B to the travel path 10, that or those travel wheels (at least one thereof) at one end of the travel path direction A are configured as driven travel wheels 14A (constituting one example of driven travel support devices) by being provided via drive wheel shafts 15A.

When that is done, the driven travel wheels 14A provided in the opposite outside portions in the transverse direction B are deployed at two places in positions at opposite angles relative to the rectangular frame shaped lower frame unit 12. By these travel wheels elongating on the inside in the transverse direction B, and having the travel wheels that are supported by adjacent intermediate lower frames 12*b* attached to the inner end portions thereof, those travel wheels are also configured as driven travel wheels 14A. Also, to the two drive wheel shafts 15A are interlockingly linked induction type motors 16 (constituting one example of rotation drive means) equipped respectively with speed reducers, which motors 16 are attached to the intermediate lower frames 12*b*.

Provided at the top at the fore and aft ends in the lateral lower frames 12*a* are cylindrical rubber stoppers 17. With the members and parts indicated above by the reference symbols 12 to 17 and so on, one example of the movable rack 11 that travels freely back and forth along the travel path 10 is configured.

As diagrammed in FIGS. 1, 4, 5, and 7, the movable rack 11 includes pulse encoders 21 (constituting one example of travel amount detection means), respectively, near the driven travel wheels 14A (driven travel support devices) on the inside that are the side portions in the transverse direction B, and these pulse encoders 21 are connected to a control panel 20 (constituting one example of control means, described further below) provided on a side surface of the movable rack 11.

More specifically, the pulse encoder 21 is configured by a bracket 22 from the side of the lower frame unit 12, a support frame unit 24 deployed so that it freely swings up and down via a lateral shaft 23 along the transverse direction B, a detection wheel unit 27 supported via bearings 25 by that support frame unit 24 so that a wheel unit shaft 26 turns freely, a turning unit 28 attached to the wheel unit shaft 26, and photoelectric switches 29*a* and 29*b* deployed on the side of the support frame unit 24 to be opposed by slits 28*a* and 28*b* formed in that turning unit 28, and the like.

Here, in the turning unit 28, the indentation shaped outer slits 28*a* and the square hole shaped inner slits 28*b* are formed respectively at intervals of a set angle, at which time the outer slits 28*a* and the inner slits 28*b* are shifted, relatively, in the circumferential direction, by an angle that is half the set angle. The photoelectric switches comprise an outside photoelectric switch 29*a* opposed to the outer slits 28*a* and an inner photoelectric switch 29*b* opposed to the inner slits 28*b*. The photoelectric switches 29*a* and 29*b* are connected to the control panel 20.

Also, the pressure contact of the detection wheel unit 27 against the floor surface 1*a* is accomplished when the support frame unit 24 side descends due to its own weight, but it is also permissible to energize the support frame unit 24 by an energizing unit (such as a compressed coil spring or flat spring or the like) so that it descends. One example of the pulse encoder 21 is configured by the members and parts 22 to 30 noted above.

As diagrammed in FIGS. 1, 2, 6, and 8, a detectable member 31 that allows vehicles to cross over it is deployed along the direction A of the travel path on the floor 1 side within the transverse direction B to the travel path 10.

More specifically, the detectable member 31 is in the form of a sheet rail, laid down on the floor surface 1*a* between the two inside wheel units 14A (driven travel support devices) and in the center of the transverse direction B to the travel path 10. The detectable member 31 is secured to the top of the floor surface 1*a* by securing hardware employed at multiple places in the length direction thereof. The securing may also be done by an adhesive method or the like. Here, the thickness (height) of the detectable member 31 is made 9 mm, for example, configured to allow vehicles like fork-lifts or hand-pushed dollies traveling on the floor surface 1*a* to cross over.

Provided in the movable rack 11 are widthwise shift detection means 35 that, while detecting with reference to the detectable member 31, detect widthwise shifts in the movable rack 11. More specifically, a bracket 36 is connected from the center portion of the travel path direction A at the intermediate lower frame 12*b* in the center portion of the transverse direction B, and a pair of proximity sensors 35*a* and 35*b* is deployed together in the transverse direction B in that bracket 36. Here, the proximity sensors 35*a* and 35*b* are configured by photosensors that measure light quantities reflected from the detectable member 31, deployed with an installation interval relative to the width of the detectable member 31 so that ordinarily the same detection values (light quantities) can be detected simultaneously from the detectable member 31, and connected to the control panel 20.

Figure 4:
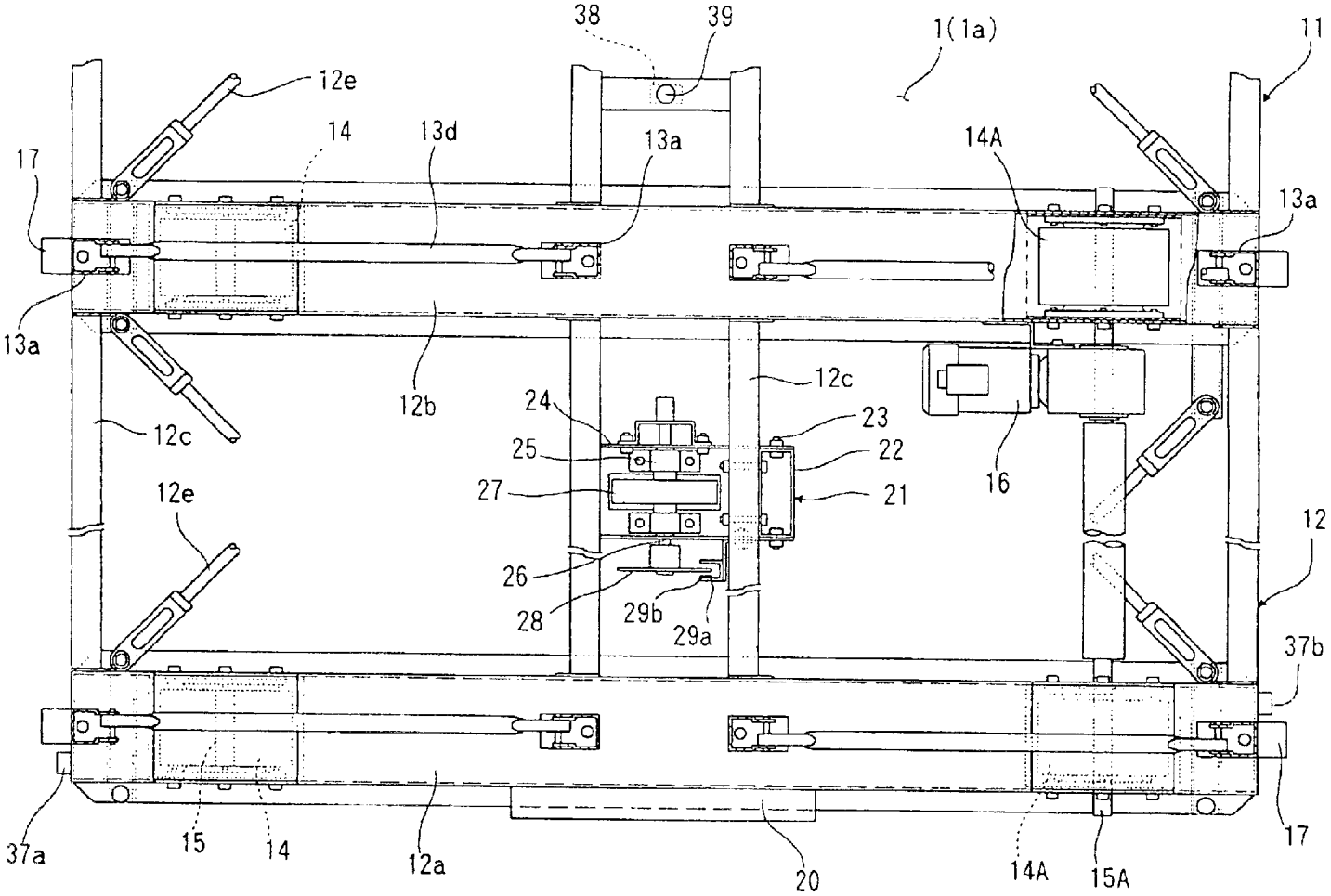
FIG. 4 is a partially cutout plan of a main part of a movable rack in the same movable rack system.
Figure 5:
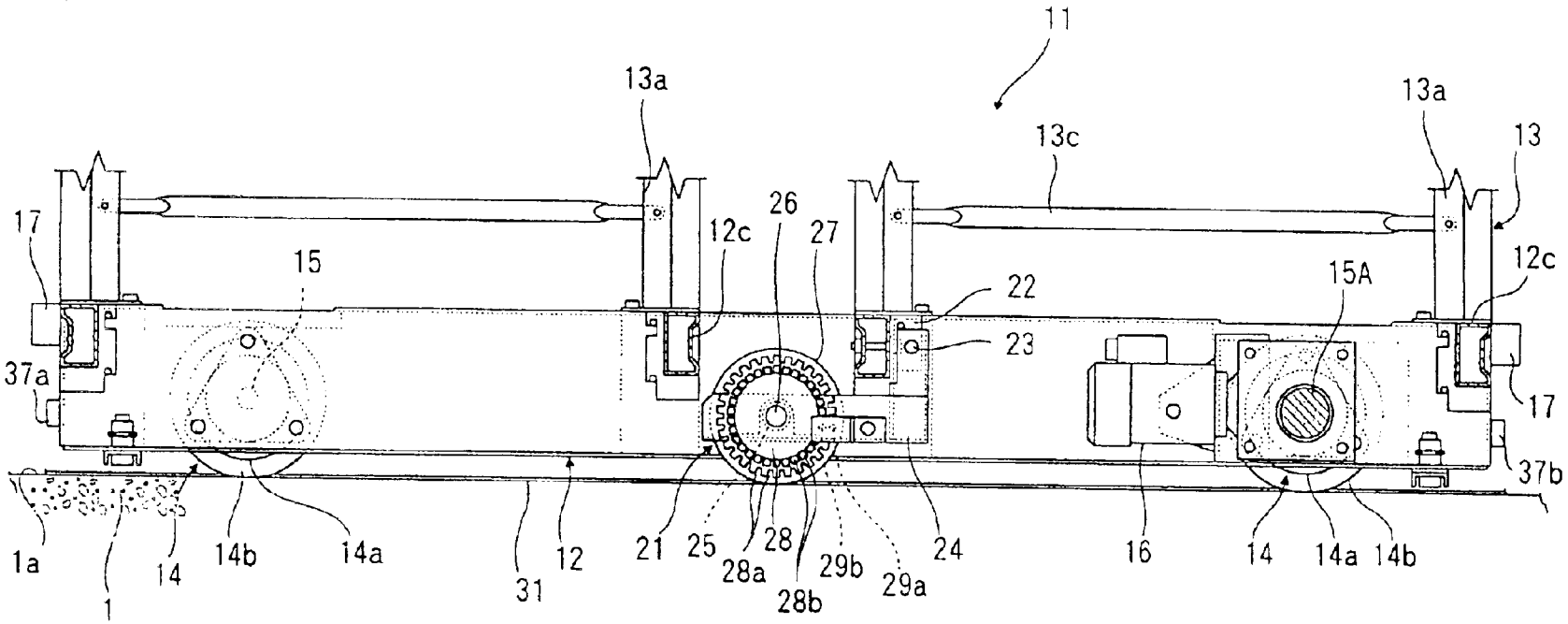
FIG. 5 is a longitudinal sectional side elevation of a drive means and a widthwise shift detection means each of the movable rack in the same movable rack system.
Figure 6:
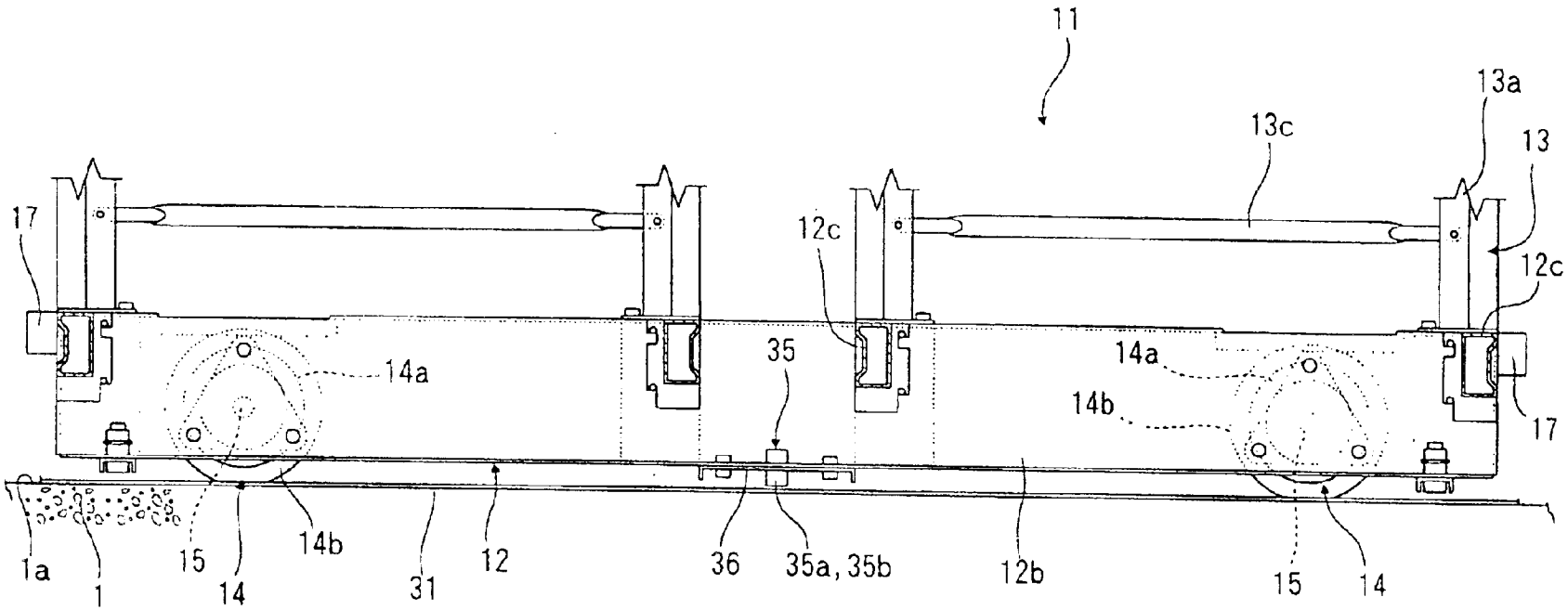
FIG. 6 a longitudinal sectional side elevation of a travel amount detection means of the movable rack in the same movable rack system.
Figure 7:
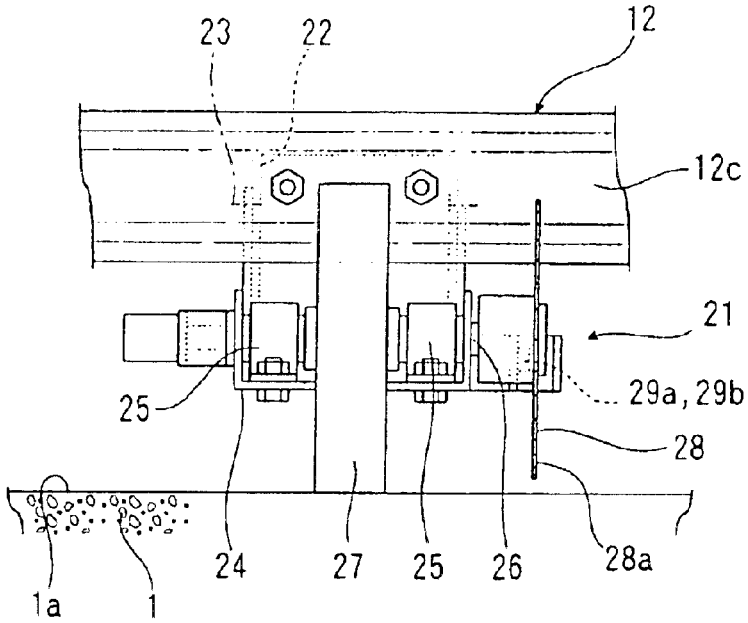
FIG. 7 is a longitudinal sectional front elevation of the travel amount detection means of the movable rack in the same movable rack system.

As diagrammed in FIG. 4 and FIG. 5, proximity sensors 37*a* and 37*b* for detecting the proximity of adjacent movable racks 11 are provided respectively to the front and back surfaces of the lower frame unit 12 of the movable rack 11, and those proximity sensors 37*a* and 37*b* are connected to the control panel 20. The proximity sensors 37*a* and 37*b* are configured by magnetic sensors, reflection type photoelectric switches, or ultrasonic sensors or the like.

As diagrammed in FIG. 1 and FIG. 4, moreover, a starting point 38 consisting of a reflecting plate indicating the travel starting point (HP=home position) is provided on the floor 1 for each of the movable racks 11, with the position thereof changed in the transverse direction B (left and right directions), and, as diagrammed in FIG. 4, in each movable rack 11 is provided a starting point sensor 39 consisting of a photoelectric switch, at a position opposing that starting point 38.

The control panels 20 provided in the movable racks 11 are connected to a main control panel 40. That main control panel 40 is for controlling all of the movable rack system, and is provided with an on/off switch for the movable rack system and travel controllers (buttons) and the like for the movable racks 11. The configuration is made so that, by operating the travel controllers, a travel direction signal is sent as a travel command to the control panel 20 of a movable rack 11 being moved, or, when a plural number of movable racks 11 is being moved simultaneously, control is effected so that the racks are sequentially activated (started) at a set interval (2 to 3 seconds).

As diagrammed in FIG. 9, in the control panel 20 of each movable rack 11 are provided a movable rack controller 41 consisting of a computer, and vector control inverters 42*a* and 42*b* for torque-vector controlling the motors 16 deployed in the transverse direction B (left and right direction), respectively, in response to the values of speed commands output from that movable rack controller 41. Those vector control inverters 42*a* and 42*b*, respectively, are configured to compute, at high speed, outputs corresponding to load conditions by a high-speed processing unit (CPU), optimally control voltage and current vectors, and raise the starting torque. By using these vector control inverters 42*a* and 42*b* to effect torque-vector control, rotation drive little affected by load fluctuations is performed, and diagonal travel caused by unbalanced weight distribution of the goods accommodated inside the movable racks 11 is held down to a minimum.

Connected to the movable rack controller 41 described above are the main control panel 40, left and right pulse encoders 21 (photoelectric switches 29*a* and 29*b*), left and right proximity sensors 35*a* and 35*b*, fore and aft proximity sensors 37*a* and 37*b*, and starting point sensor 39. And the movable rack controller 41 is configured as follows to comprise:

a travel judgment unit 43 for inputting a travel direction signal from the main control panel 40 and proximity signals for adjacent movable racks 11 from the fore and aft proximity sensors 37*a* and 37*b*, determining by the travel direction signal whether to cause a movable rack 11 to move forward or backward, outputting a move ahead command or a move back command, and outputting a stop command by the proximity signal of the proximity sensor 37*a* or 37*b* in the direction of travel;

a travel reset unit 44 for one-pulse outputting a travel start signal when a travel command output from the travel judgment unit 43 has changed to a move ahead command or move back command;

a first counter 45 that is reset when the starting point sensor 39 is detecting the starting point 38 and a move ahead command has been output from the travel judgment unit 43, counts pulses output from the left pulse encoder 21, and measures the travel distance (one example of travel amount) of the left driven travel wheel 14A;

a second counter 46 that is reset when the starting point sensor 39 is detecting the starting point 38 and a move ahead command has been output from the travel judgment unit 43, counts pulses output from the right pulse encoder 21, and measures the travel distance (one example of travel amount) of the right driven travel wheel 14A;

a pulse error judgment unit 47 that is reset by a travel start pulse signal output from the travel reset unit 44, counts the numbers of pulses output from the left and right pulse encoders 21, respectively, detects differences in the two pulse counts, outputs (turns on) a prediction control execution signal when that difference exceeds a set value (which setting is changeable), and turns off the prediction control execution signal when the difference in pulse counts returns roughly to 0;

a first differentiator 48 for differentiating the travel distance of the left driven travel wheel 14A detected by the first counter 45, multiplies that by a coefficient described subsequently and finds the (forward) travel distance during a certain time interval by the left driven travel wheel 14A;

a first adder 49 that adds the (forward) travel distance during a certain time interval by the left driven travel wheel 14A found by the first differentiator 48 to the travel distance of the left driven travel wheel 14A detected by the first counter 45 and finds a predicted travel distance (predicted value for travel distance) after a certain time period;

a second differentiator 50 for differentiating the travel distance of the right driven travel wheel 14A detected by the second counter 46, multiplies that by a coefficient described subsequently and finds the (forward) travel distance during a certain time interval by the right driven travel wheel 14A;

a second adder 51 that adds the (forward) travel distance during a certain time interval by the right driven travel wheel 14A found by the second differentiator 50 to the travel distance of the right driven travel wheel 14A detected by the second counter 46 and finds a predicted travel distance (predicted value for travel distance) after a certain time period;

a first subtractor 52 for subtracting the travel distance of the right driven travel wheel 14A detected by the second counter 46 from the travel distance of the left driven travel wheel 14A detected by the first counter 45 and finding the travel distance deviation between the left and right driven travel wheels 14A;

a second subtractor 53 for subtracting the predicted travel distance after a certain time interval by the right driven travel wheel 14A found by the second adder 51 from the predicted travel distance after a certain time interval by the left driven travel wheel 14A found by the first adder 49 and finding the predicted travel distance deviation between the left and right driven travel wheels 14A;

a timer 54 that starts counting time by a travel start pulse signal output from the travel reset unit 44, stops counting time by a prediction control execution signal output from the pulse error judgment unit 47, measures the time from travel start until a difference in pulse counts that exceeds a set value occurs, and outputs the coefficient, noted earlier, that is inversely proportional to that measured time, that is, a coefficient based on the trend until the difference in pulse counts exceeds the set value (deviation between travel amounts exceeds a specified value); and a speed controller 55 for finding speed command values (corresponding to drive rotation amounts by rotation drive means) for the left and right vector control inverters 42*a* and 42*b*, based on the travel judgment signal of the travel judgment unit 43, the travel distance deviation between the left and right driven travel wheels 14A found by the first subtractor 52, the predicted travel distance deviation between the left and right driven travel wheels 14A found by the second subtractor 53, the prediction control execution signal output from the pulse error judgment unit 47, and data on the detectable member 31 being detected by the left and right proximity sensors 35*a* and 35*b*, and outputting those speed command values.

The configuration of the speed controller 55 is diagrammed in FIG. 10. As represented in FIG. 10, a relay RY-F that is activated when the travel command signal of the travel judgment unit 43 is a move ahead command, a relay RY-B that is activated when that signal is a move back command, a relay RY-S that is activated when that signal is a stop command, and a relay RY-M that is activated when the prediction control execution signal of the pulse error judgment unit 47 is on are provided. A speed setter 61 is also provided wherein a prescribed travel speed for the movable rack 11 is set. The configuration is such that, by the action of the relay RY-M, when the prediction control execution signal is not on, the travel distance deviation is selected, and when the prediction control execution signal is on, the predicted travel distance deviation is selected, and, furthermore, so that that selected deviation is selected when a timer (described subsequently) is off, and, when the timer is on, no distance deviation (deviation=0) is selected. A first function unit 62 for finding the speed correction amount for the left driven travel wheel 14A, and a second function unit 63 for finding the speed correction amount for the right driven travel wheel 14A, by the deviation selected, as noted above, are provided. The first function unit 62, when the deviation becomes positive, exceeding a prescribed positive amount (dead band), outputs a speed correction amount that is proportionally positive, while the second function unit 63, when the deviation becomes negative, exceeding a prescribed negative amount (dead band), outputs a speed correction amount that is proportionally positive. Also, a first comparator 64 is provided that operates when the selected deviation exceeds a positive or negative prescribed amount (dead band), that is, when a speed correction amount is output from the first function unit 62 or second function unit 63, and a relay RY-P is provided that operates by the operation of that first comparator 64.

Furthermore, a first subtractor 65 is provided that computes the widthwise shift in the transverse direction B to the travel path 10, by way of subtraction of data on the detectable member 31 detected by the left and right proximity sensors 35*a* and 35*b*. And, a second comparator 72 is provided that operates, when the widthwise shift of the movable rack 11 from that first subtractor 65 exceeds a positive or negative prescribed amount (dead band of function units 66 and 67, described further below), and an off delay timer 73 is provided that operates by the operation of that second comparator 72. The configuration is further made so that the widthwise shift in the movable rack 11 from the first subtractor 65 is selected when the relay RY-P is not operating, and no widthwise shift (widthwise shift=0) is selected when the relay RY-P is operating, and a third function unit 66 that finds a speed correction amount for the left driven travel wheel 14A from the selected widthwise shift and a fourth function unit 67 that finds a speed correction amount for the right driven travel wheel 14A are provided. The third function unit 66, when the widthwise shift becomes positive, exceeding a prescribed amount (dead band) that is positive (widthwise shift to the left), outputs a positive speed correction amount that is proportionally positive, while the fourth function unit 67, when the deviation becomes negative, exceeding a prescribed value (dead band) that is negative, outputs a speed correction amount that is proportionally positive. Movable rack widthwise shifts are correctively controlled by the speed correction amounts output from the third function unit 66 or fourth function unit 67.

Further provided are a second subtractor 68 for subtracting positive speed correction amounts output from the first function unit 62 and third function unit 66 from the prescribed travel speed of the movable rack 11 set in the speed setter 61, and finding speed command values for the left driven travel wheel 14A, and a first lower limit limiter 69 for limiting the lower limit of the speed command value for the left driven travel wheel 14A found by that second subtractor 68 and guaranteeing a minimum speed. Whereby, it is so configured that a speed command value for the left driven travel wheel 14A, of which lower limit is limited, is selected by the operation of the relay RY-F (on with move ahead command); a value that makes negative the speed command value for the left driven travel wheel 14A, of which lower limit is limited, is selected by the operation of the relay RY-B (on with move back command); a speed command value of "0" is selected for the left driven travel wheel 14A by the operation of the relay RY-S (on with stop command); and the speed command value is output to the left vector control inverter 41*a*.

Further provided are a third subtractor 70 for subtracting speed correction amounts output from the second function unit 63 and fourth function unit 67 from the prescribed travel speed of the movable rack 11 set in the speed setter 61, and finding speed command values for the right driven travel wheel 14A, and a second lower limit limiter 71 for limiting the lower limit of the speed command value for the right driven travel wheel 14A found by that third subtractor 70 and guaranteeing a minimum speed. Whereby, it is so configured that a speed command value for the right driven travel wheel 14A, of which lower limit is limited, is selected by the operation of the relay RY-F (on with move ahead command); a value that makes negative the speed command value for the right driven travel wheel 14A, of which lower limit is limited, is selected by the operation of the relay RY-B (on with move back command); a speed command value of "0" is selected for the right driven travel wheel 14A by the operation of the relay RY-S (on with stop command); and the speed command value is output to the right vector control inverter 41*b*.

When the speed command value is positive, the speed command value indicates a forward speed command value, and when negative, that indicates a reverse speed command value.

Operations based on the configuration of the control panel 20 described above are now described.

First, when a travel direction signal is input from the main control panel 40, the travel direction is judged, either a move ahead command or a move back command is formed, and the prescribed travel speed of the movable rack 11 set in the speed setter 61 is output to the left and right vector control inverters 41*a* and 42*b* as a speed command value. The motors 16 are controlled to an r.p.m. corresponding to the speed command value by the left and right vector control inverters 41*a* and 42*b*, and the movable rack 11 begins to move either forward or back. For a move ahead command, the speed command value is formed to be positive, while for a move back command, the speed command value is formed to be negative.

When the travel is started, the travel distances of the left and right driven travel wheels 14A are found by output pulses from the left and right pulse encoders 21. The deviation between those travel distances, that is, the inclination of the movable rack 11, that is the difference in travel directions between the two sides of the movable rack 11, is found, and a speed command value for the left and right driven travel wheels 14A is found to make the inclination 0 and is output to the left and right vector control inverters 41*a* and 42*b*.

In an ordinary travel control is being operated, in which the speed command values for the left and right driven travel wheels 14A are found based on the travel distance deviation noted above, when the difference in pulse counts between the left and right pulse encoders 21 exceeds a set value and the prediction control execution signal goes on, that is, when the inclination noted above becomes large, the time period from the start of movement until the set value is exceeded is found, a tendency in the deviation between travel amounts is found from the time period, and a coefficient based on that tendency is found. Also, changes in the current travel distances are found by differentiating the travel distances of the driven travel wheels 14A, the travel distance (advance component) within a certain time period is found by multiplying the current travel distance by the coefficient based on the tendency in the travel distance deviation noted above, the predicted travel distances after a certain time period are found by adding the current travel distances to the travel distance within the certain time period, and the deviation between the predicted travel distances is found. Then the speed command values for the left and right driven travel wheels 14A, of which predicted travel distance deviation is made 0, are found, and those are output to the left and right vector control inverters 41*a* and 42*b* (i.e. movable rack attitude correcting control is effected). Predicted travel distances are found for each prescribed time period.

During this movable rack attitude correcting control, the speed command values are controlled relative to the vector control inverter 41*a* of the motor 16 linked to the driven travel wheel 14A on the side where the travel distance has increased so that the drive rotation amount thereof is reduced. Switching between forward and reverse drive is effected by the plus and minus signs of the speed command values.

Thus a difference in the drive rotation amount between the motors 16 will develop, of which inclined attitude described earlier can be gradually corrected and eliminated. Furthermore, by being able to effect control so that the side, on which the travel distance has increased, advances at a lower speed than the other side, the inclined attitude can be gradually corrected and eliminated without causing collisions or the like between the movable racks 11.

Then, when the difference in the counts of pulses output respectively from the pulse encoders 21 returns roughly to 0, the prediction control execution signal turns off, and ordinary travel control based on the travel distance deviation is resumed.

Also, the shift in the transverse direction (left and right direction) B to the travel path 10 is found, based on data on the detectable member 31 found by the proximity sensors 35*a* and 35*b*, and, when that shift exceeds a prescribed amount (dead band) set in the second comparator 72, the speed correction amount based on the travel distance deviation or the predicted travel distance deviation is set to 0, and movable rack widthwise shift correcting control is effected instead of the movable rack attitude correcting control (that is, a movable rack widthwise shift correcting control is effected prior to a movable rack attitude correcting control). That is, a speed correction amount is output from the third function unit 66 or the fourth function unit 67 so that the widthwise shift in the transverse direction B is made 0, speed command values for the left and right driven travel wheels 14A are found, of which one of the drive rotation amounts is reduced, the speed command values are output to the left and right vector control inverters 41*a* and 42*b*, and the movable rack widthwise shift correcting control is effected.

Thus the movable rack 11 that was traveling in a perpendicular attitude is gradually made to have an inclined attitude, the proximity sensors 35*a* and 35*b*, respectively in conjunction therewith, move to be above the detectable member 31, and the widthwise shift can be eliminated. Furthermore, by having the movable rack widthwise shift correcting control effected with priority over the movable rack attitude correcting control, so-called widthwise shift is eliminated, and, when eliminated, the movable rack attitude correcting control is again effected after a delay of the time period set in the timer 73, and the attitude is modified so that the travel of the movable rack 11 is performed in a perpendicular attitude relative to the travel path 10.

The correction of the speed command values for the left and right driven travel wheels 14A is performed between the prescribed travel speed of the movable rack 11 set in the speed setter 61 and the minimum speeds set in the lower limit limiters 69 and 71.

When a move ahead command is output with the movable racks 11 having been returned to the starting point, in a condition in which the origin sensors 39 are operating, the count values of the counters 45 and 46 are reset, and travel distance starting point correction is effected.

Then, when the proximity sensor 37*a* or 37*b* in the travel direction is operating, a stop command is formed, the speed command value is made to be "0," the r.p.m. values of the motors 16 are controlled to "0" by the left and right vector control inverters 41*a* and 42*b*, and the movable rack 11 stops.

The actions in the first embodiment described in the foregoing are described below.

Figure 2:
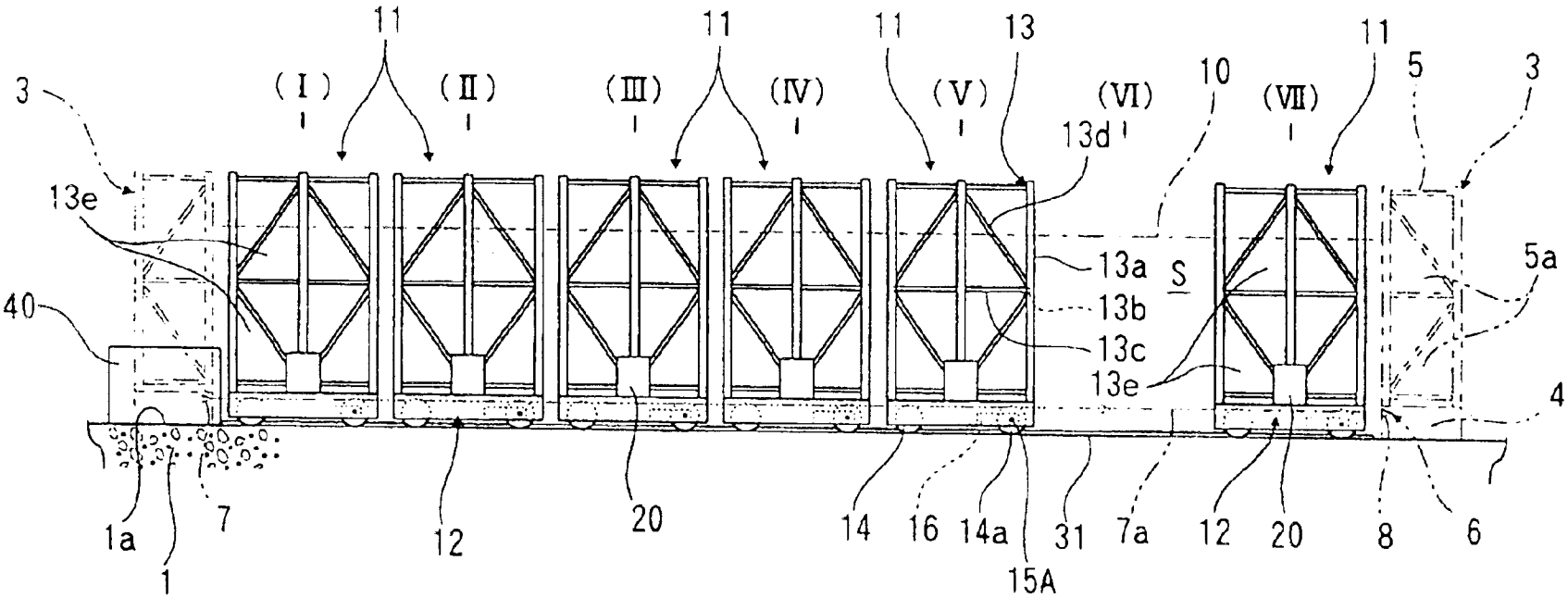
FIG. 2 is a side elevation of the same movable rack system.

As diagrammed in FIG. 1 and FIG. 2, by causing one or a plurality of movable racks 11 to travel on a travel path 10, it is possible to form a work corridor S in front of a targeted movable rack 11, and to perform the loading and unloading of goods in and from targeted accommodating section spaces 13*e* from that work corridor S. The loading and unloading of the goods is performed by, for example, causing a forklift to travel inside the work corridor S, using pallets.

When that is being done, only a detectable member 31 which allows vehicles to cross thereover exists on the floor surface 1*a* in the work corridor S, and nothing exists on the floor surface 1*a* on the opposite lateral sides of the work corridor S. Therefore, the traveling of a vehicle such as a forklift can be done in any direction, allowing the vehicle also to travel to pass through the work corridor S in one direction. Thus, such works as using the work corridor S, like loading and unloading of goods, can be performed quickly and smoothly.

When, for example, a movable rack 11 that is stopped at a stop position V in FIG. 1 and FIG. 2 is to be made to move along the travel path 10 and then stopped at a stop position VI, first the main control panel 40 is operated. Thereby, a travel command signal (travel direction signal) is sent to the control panel 20 of the movable rack 11 that is stopped at the stop position V.

When that is done, the pair of motors 16 are activated, and the driven travel wheels 14A are driven to turn via the respective drive wheel shafts 15A. Thus it is possible to impart travel forces to the movable rack 11, and, thereby, while causing the remaining travel wheels 14 to effect following turning (free turning), to get the movable racks 11 to travel along the travel path 10. Then, by detection control effected by proximity sensors 37*a* and 37*b* or the like provided between the movable racks 11, it is possible to cause the movable rack 11 to stop at an initial stop position VI without causing it to collide or the like with the movable rack 11 stopped in the stop position VII.

When the movable racks 11 are traveling as described in the foregoing, there are such cases that, due to the off-center loading of goods accommodated therein, the flatness (irregularity) of the floor surface 1*a*, slipping of the driven travel wheels 14A against the floor surface 1*a*, or wears in the outside ring units 14*b* in the driven travel wheels 14A and the like, the travel of a movable rack 11 will not be performed in a perpendicular attitude being maintained relative to the travel path 10, but in an attitude as shown by imaginary lines in FIG. 1, for example, in which one side portion of the movable rack advances while the other side portion lags behind in an inclined attitude.

In such a case, travel distances are detected by the pulse encoders 21 deployed discretely in the opposite outside portions in the transverse direction B, and the drive rotation amounts produced by the motors 16 are controlled by the control panel 20 based on the detection results. That is, in conjunction with the traveling of the movable rack 11, the detection wheel unit 27 pressing against the floor surface 1*a* is caused to effect frictional turning. By the turning of that detection wheel unit 27, the turning unit 28 is caused to be turned via the wheel unit shaft 26.

Thereupon, by the turning of the turning unit 28, the numbers of movements (number of passings) of the groups of slits 28*a* and 28*b* formed in that turning unit 28 can be counted by the photoelectric switches 29*a* and 29*b*, and input to the control panel 20. In that control panel 20, by counting the pulses output from the two pulse encoders 21, the travel distances of the respective driven travel wheels 14A are found and compared, and, in this case, the condition will be such that the travel distance of the driven travel wheel 14A on one side is larger (advanced), while the travel distance of the driven travel wheel 14A on the other side is small (delayed).

Based on that comparison, a control signal is sent out from the control panel 20, to the motor 16 linked to the driven travel wheel 14A on the side where the travel distance is larger, that is, to the vector control inverter 42*a* or 42*b* of the motor 16 linked to the driven travel wheel 14A on one side, to reduce the drive rotation amount. Thereby, the drive rotation amount of the motor 16 on that one side will be reduced, and the wheel on that one side will advance at a lower speed than the other side wheel, whereupon the inclined attitude described earlier can be gradually corrected and eliminated.

In the control panel 20, furthermore, when a pulse difference arises in the pulses output from the two pulse encoders 21, which difference exceeds a set value, from the start time of movement, a predicted travel distance is found which corresponds to the travel distance and to the period of time since the start of movement until the pulse difference occurs, during which the pulse difference exceeds the set value. And a control signal is sent out to the vector control inverter 42*a* or 42*b* of the motor 16 linked to the driven travel wheel 14A on the side where the predicted travel distance has increased to reduce that drive rotation amount. Thereby, the drive rotation amount of the motor 16 on that one side will be reduced and the wheel on that one side will advance at a lower speed than the other side wheel, and the inclined attitude can be gradually corrected, ahead of time, in response to the predicted travel distance, and eliminated. By this prediction control, under the conditions of the floor surface 1*a* or the loading conditions, in which a waveform tracing is made as indicated by the solid line in FIG. 11, an overshooting as indicated by the broken line in FIG. 11*a* results when only the travel distance deviation alone is controlled. Whereas, the broken line in FIG. 11*b* indicates that an overshooting can be eliminated to perform a stabilized travel control.

By thus performing a control via the control panel 20, the travel of the movable racks 11 can be effected in an attitude perpendicular to the travel path 10.

Furthermore, in the control panel 20, when the travel distances of the respective driven travel wheels 14A are compared, and either there is no difference therebetween, or the difference is minute (when within the dead band), no control signal to reduce the drive rotation amount is sent out from the control panel 20, whereupon the travel is continued at the initial r.p.m. set in the speed setter 61.

When a pulse encoder 21 is adopted as the travel distance detection means, as described in the foregoing, a group of outer slits 28*a* and a group of inner slits 28*b* formed respectively at set angular intervals on the turning unit 28 can be relatively shifted in the circumferential direction by an angle that is half the set angle. Thereby, the detection of the travel distances in the opposite outside portions in the transverse direction to the movable racks 11 can be accurately effected, by making the detection amounts to be fine.

When a movable rack 11 travels as described in the foregoing, there is a danger of so-called widthwise shifted travel being effected, in which the movable rack 11 shifts in the transverse direction B, irrespective of the fact that the traveling of the movable rack 11 is effected in a perpendicular attitude relative to the travel path 10, for example. In such a case, while causing the movable rack 11 to move, the detectable member 31 deployed along the travel path direction A is detected by proximity sensors 35*a* and 35*b* that are the widthwise shift detection means 35, and, thereupon, the motors 16 are controlled by the control panel 20 so that the difference in the detection values of the proximity sensors 35*a* and 35*b* disappears.

Figure 8:
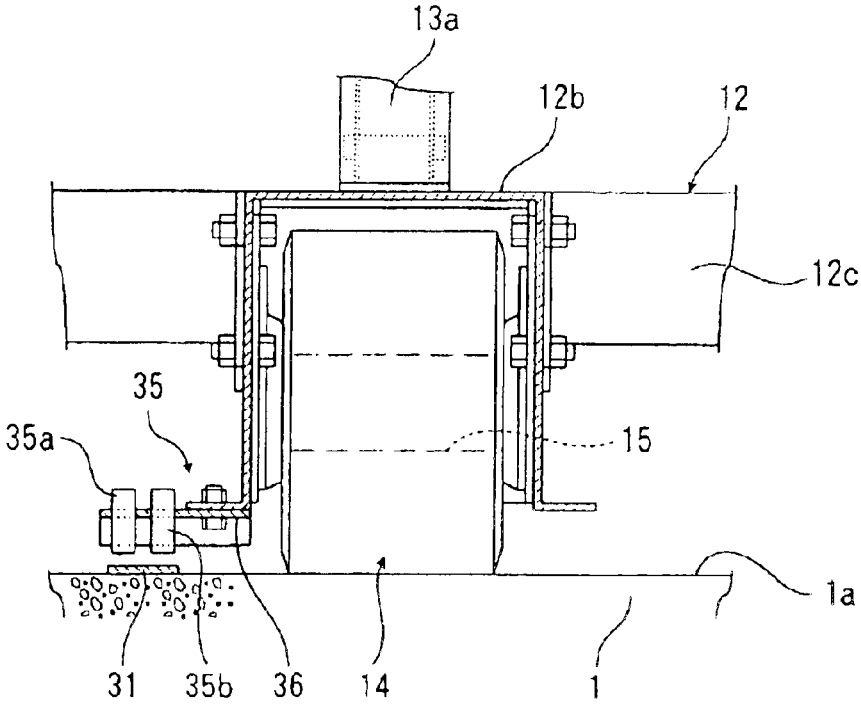
FIG. 8 is a longitudinal sectional side elevation of a movable rack widthwise shift detection means in the same movable rack system.
Figure 11A:
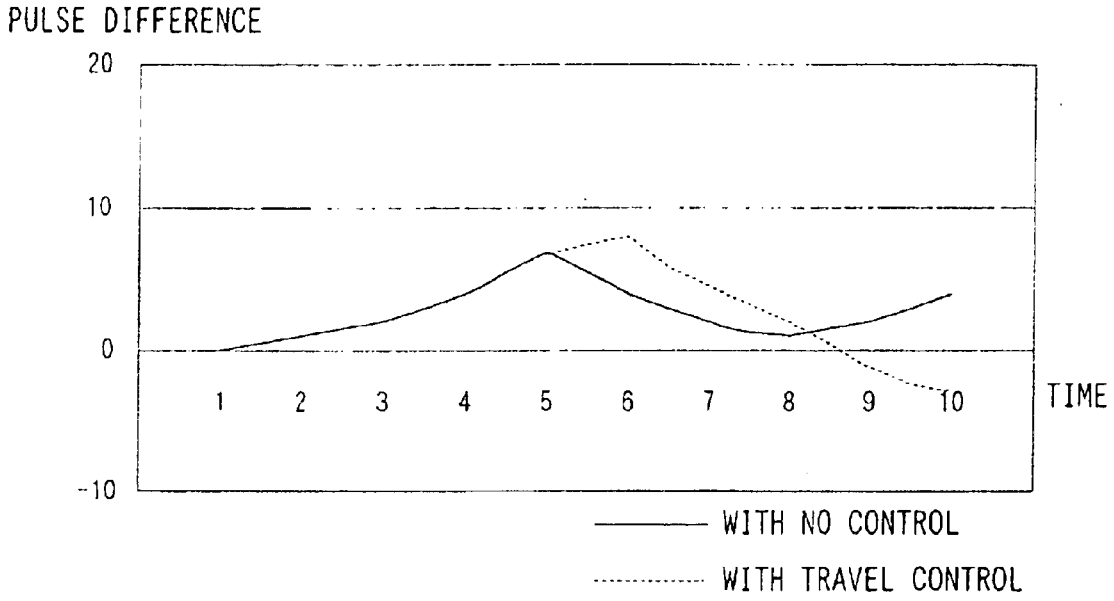
FIG. 11*a* and FIG. 11*b* are travel-control characteristic diagrams for the movable rack in the same movable rack system.
Figure 11B:
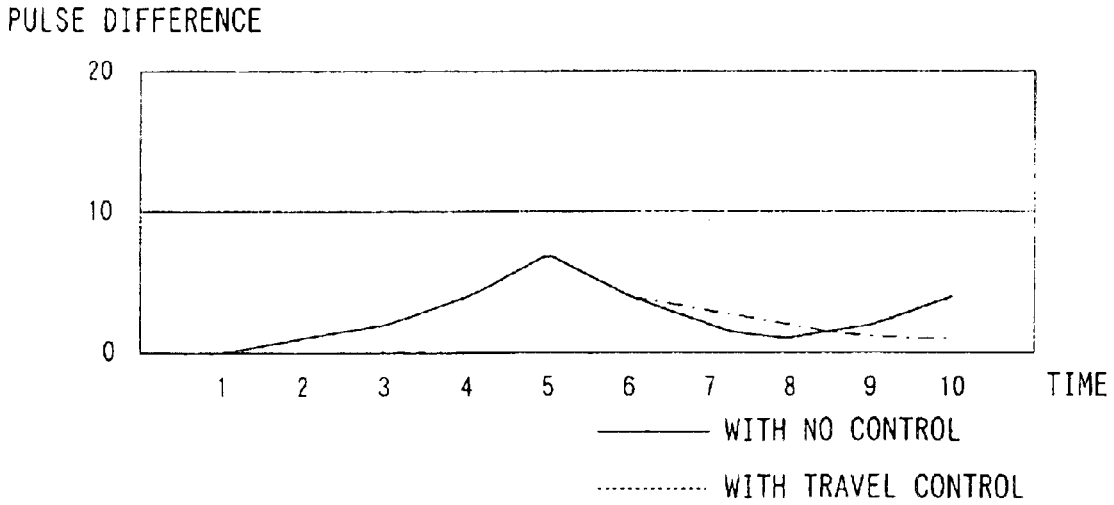

That is, when the traveling is such that no widthwise shift is occurring, the proximity sensors 35*a* and 35*b* detect the detectable member 31 simultaneously as diagrammed in FIG. 8. Then, when a widthwise shift occurs, of the pair of proximity sensors 35*a* and 35*b*, the proximity sensor 35*a* or 35*b* on the shift side will detect the floor surface 1*a*, whereby a difference in the detection values will occur in the control panel 20.

Whereupon, a control signal will be sent from the control panel 20 to the vector control inverter 41*a* or 42*b* of the motor 16 linked to the driven travel wheel 14A on the opposite side from the shift side, causing the drive rotation amount thereof to be reduced. Thereby, the drive rotation amount of the motor 16 on that opposite side will be reduced, and that opposite side will advance at a lower speed than the shift side, so that the movable rack 11 that was traveling in a perpendicular attitude will gradually be put in an inclined attitude, and, in conjunction therewith, the proximity sensor 35*a* or 35*b* on the shift side will approachingly move toward the detectable member 31 side to eliminate the widthwise shift.

By the control panel 20, ordinarily, the attitude is corrected by the movable rack attitude correcting control so that the travel of the movable racks 11 is conducted in a perpendicular attitude relative to the travel path 10, but, when a widthwise shift occurs, the movable rack widthwise shift correcting control is executed with priority over the movable rack attitude correcting control, the widthwise shift is eliminated. And, when the widthwise shift is eliminated, the movable rack attitude correcting control is resumed after a certain period of time, and the attitude is corrected so that the travel of the movable racks 11 is performed in a perpendicular attitude relative to the travel path 10.

Moreover, when a widthwise shift has already occurred at the travel start time, the movable rack widthwise shift correcting control is first executed, and, after the widthwise shift has been eliminated, the movable rack attitude correcting control is executed.

In the foregoing description, a movable rack 11 that was traveling in a perpendicular attitude is gradually made to assume an inclined attitude by reducing the drive rotation amount of the motor 16 linked to the driven travel wheel 14A on the opposite side from the shift side, but, even when the control has been effected to reduce the drive rotation amount of the motor 16 linked to the driven travel wheel 14A on the shift side, in like manner, the movable rack 11 that was traveling in a perpendicular attitude can be gradually made to assume an inclined attitude.

By the above described operation, movable racks 11 can be made to travel without any occurrence of large widthwise shifts. Moreover, by the widthwise shift detection means 35 and the detectable member 31 deployed at one place in the center portion, such a configuration as for detecting widthwise shifts in the movable racks 11 can be provided simply and inexpensively. Also, by incorporating the travel distance control of the opposite outside portions in the transverse direction B described earlier, it becomes possible to implement the travel of movable racks 11 in a perpendicular attitude relative to the travel path 10, without occurrence of widthwise shifts. And, by deploying the detectable member 31 along the travel path direction A in the middle of the travel path 10 in the transverse direction B thereto, when a movable rack 11 is caused to move diagonally to eliminate the widthwise shift, the turning radius of the movable rack 11 can be made small, and zigzagging thereof can be reduced.

In the travel of the movable racks 11, as described in the foregoing, a plurality of movable racks can be caused to travel simultaneously, by operating travel controllers in the main control panel 40. More specifically, as diagrammed in FIG. 2, in a condition where a work corridor S is formed in a portion of a stop position VI, when control inputs are made to cause three movable racks 11 that are stopped in portions at stop positions III, IV, and V to travel simultaneously, first of all, as diagrammed in FIG. 3*a*, the movable rack 11 stopped in the portion at the stop position V is activated (caused to travel) according to the instructions from the main control panel 40.

Figure 3A:
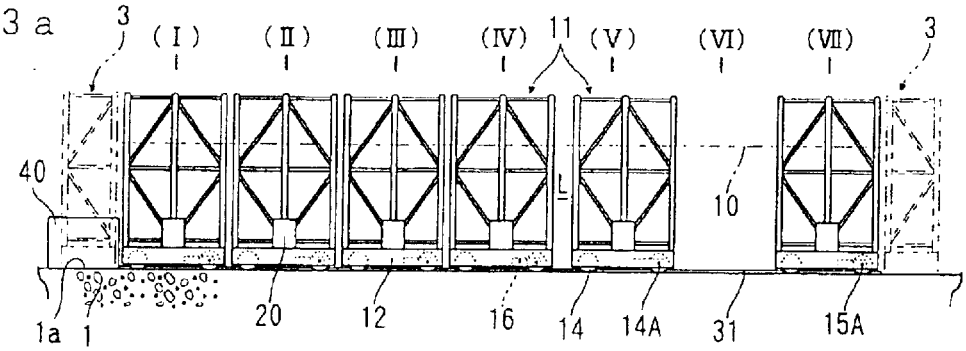
FIG. 3*a* to FIG. 3*d* are side elevations each explaining movements of multiple rack units in the same movable rack system.
Figure 3B:
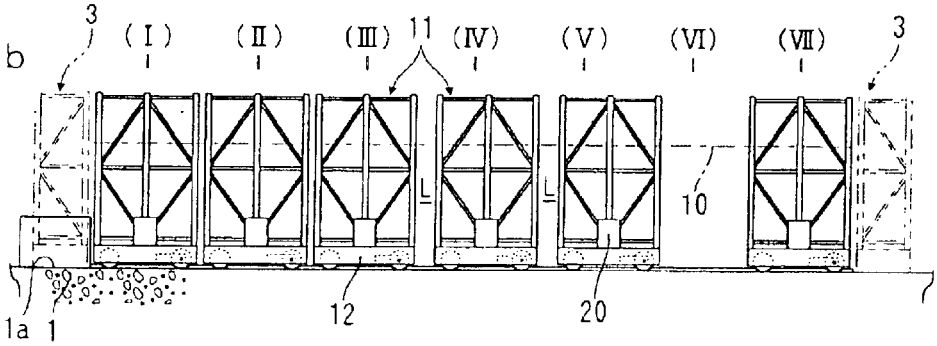
Figure 3C:
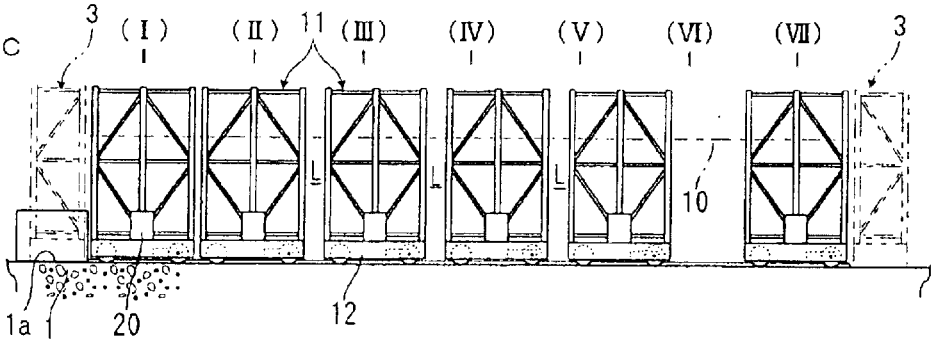

Next, after the first movable rack 11 has started to travel and a set time period (2 or 3 seconds) has passed, the second movable rack 11 stopped in the portion at the stop position IV is activated, as diagrammed in FIG. 3*b*. Then, after that second movable rack 11 has started to travel and the set time period (2 or 3 seconds) has passed, the third movable rack 11 stopped in the portion at the stop position III is activated, as diagrammed in FIG. 3*c*.

Figure 3D:
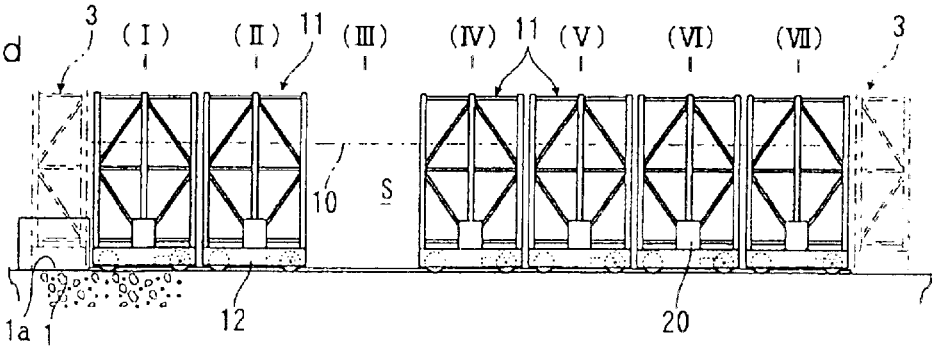

After that, out of the movable rack 11 group, the first movable rack 11 will stop first in the portion at the stop position VI, the second movable rack 11 will stop next in the portion at the stop position V, and then the third movable rack 11 will stop sequentially in the portion at the stop position IV, whereupon the racks can be stopped in close proximity to each other, as diagrammed in FIG. 3*d*.

In this manner, by sequentially activating the three movable racks 11 with a time differential, after a set time period (2 or 3 seconds) (i.e. starting them with a time differential), the simultaneous travel of the three movable racks 11 (that is, a plurality of movable racks) can be accomplished while maintaining an interval L corresponding to the set time period (2 or 3 seconds). Accordingly, although there are no rails and the movable rack 11 is prone to be inclined, a plurality of movable racks 11 can be made to travel simultaneously, without occurrence of mutual contact or collision therebetween. And, by sequentially stopping the three (a plural number) movable racks 11, the racks can be stopped in sufficiently close proximity to each other.

In controlling the travel of the movable racks 11, as described in the foregoing, the control panel 20 can master the control operations and store the same, and the traveling of the movable racks 11 can be controlled based thereon. That is, when a movable rack 11 is made to travel in an inclined attitude, for example, that inclined attitude is corrected on the basis of outputs from the pulse encoders 21. These series of control operations are stored. Then, when the movable rack 11 travels next, either in the reverse direction or in the same direction, the travel of the movable rack 11 is controlled (prediction control) based on the stored memory, so that the travel of the movable rack 11 can be implemented in a perpendicular attitude relative to the travel path 10.

When the travel of the movable rack 11 has been controlled based on the stored memory, moreover, there is a case where travel is done in an inclined attitude due to a change in loading conditions or the like, for example. In such a case, however, in like manner as described above, the inclined attitude can be corrected based on the outputs from the pulse encoders 21.

In the first embodiment described in the foregoing, as indicated by the imaginary lines in FIG. 1 to 3, for example, stationary racks 3 are deployed, according as required, toward the opposite outside ends of the travel path 10 of the movable rack 11 groups. When such is the case, a plurality of movable racks 11 will be deployed between a pair of stationary racks 3, so that the racks can travel freely back and forth in the direction between the fixed racks. Here, the stationary racks 3 are each configured by a lower frame unit 4 mounted on and fixed to the floor surface 1*a*, and a rack unit 5 installed on the lower frame unit 4, and the like. Formed in that rack unit 5 are a plurality of section accommodating spaces 5*a*, in the vertical and horizontal directions.

Disposed between the lower parts of the two stationary racks 5, moreover, are photoelectric sensors 6 for detecting obstacles. A plurality of these photoelectric sensors 6 are deployed at suitable intervals in the transverse direction B. Here, each of the photoelectric sensors 6 is a transmissive type photoelectric switch having a light projector 7 and a light receptor 8 opposed to each other. The configuration is such that detection light beams 7*a* from the light projectors 7 pass through the spaces between the floor surface 1*a* and the bottom surfaces of the lower frame units 12 in the group of movable racks 11, and are received by the light receptors 8 in opposed positions.

Thus, by having the pair of stationary racks 3, goods can be stored such that spaces can be used effectively. Also, by employing the photoelectric sensors 6, even if the movable rack is attempted to travel with a worker or workers being present in the work corridor S, such an event can be most reliably detected by the detection light beams 7*a* that cross the work corridor S, whereupon the travel of the movable racks 11 or the like can be controlled to stop. By setting the detection light beams 7*a* at a low level above the floor surface 1*a*, moreover, not only the workers, but small foreign objects that have dropped inside the work corridor S from the rack units 13 can be detected in a non-contact manner.

It may also be permissible to deploy photoelectric sensors in the front and rear surfaces of the movable racks 11, with the detection light beams thereof being set as representing the transverse direction B, or, alternatively, contact type bumpers may be installed in the lower parts of the front and rear surfaces of the movable racks 11.

[Second Embodiment]

Figure 12:
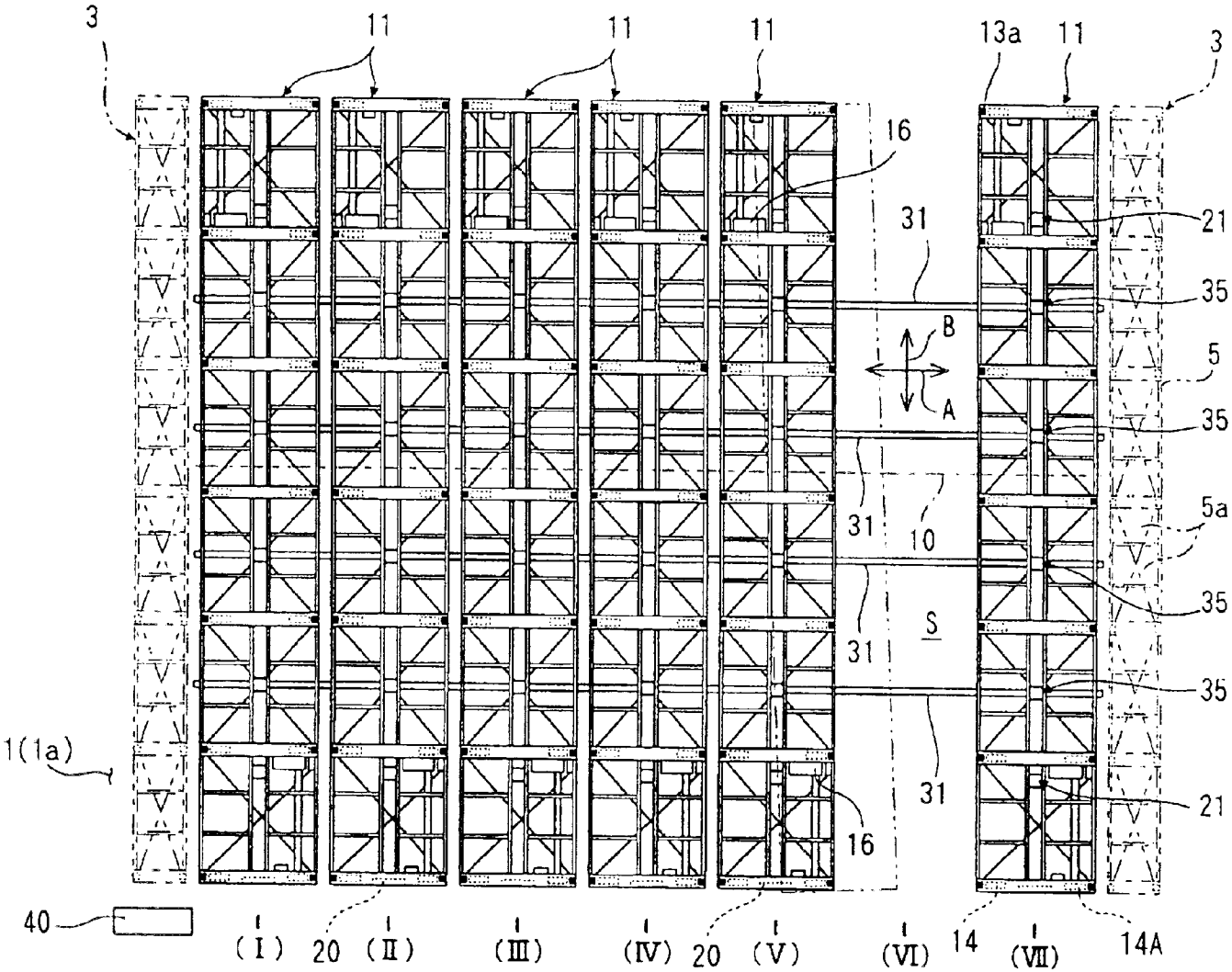
FIG. 12 is a plan of a movable rack system according to a second embodiment of the present invention.

Next, a second embodiment of the present invention is described with reference to FIG. 12.

Specifically, the detectable member 31 is laid down at four places (a plurality of places) within the transverse direction B of the travel path 10, between the two driven travel wheels (driven travel support devices) 14A. And, widthwise shift detection means 35 are deployed to oppose the detectable members 31, respectively.

In this second embodiment, widthwise shifts associated with inclinations of the movable racks 11 can be detected quickly.

[Third Embodiment]

Figure 13:
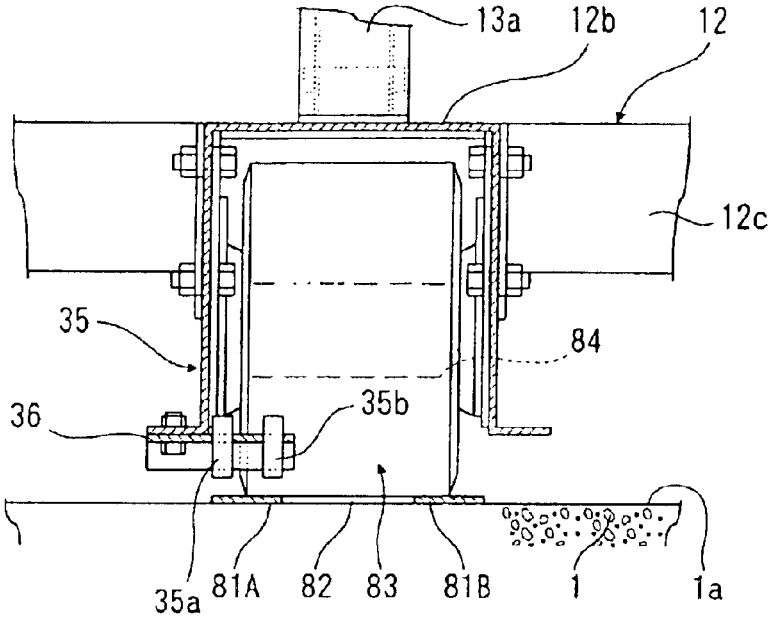
FIG. 13 is a longitudinal sectional front elevation of a movable rack widthwise shift detection means in a movable rack system according to a third embodiment of the present invention.

Next, a third embodiment of the present invention is described with reference to FIG. 13.

Specifically, a pair of detectable members 81A and 81B are laid down on the floor surface 1*a* with a gap 82 therebetween in the transverse direction B to the travel path 10. Also, a non-driven travel wheel 83 (being one example of a non-driven travel support device) made of a metal such as steel is provided via a wheel shaft 84. The non-driven travel wheel 83 is placed to span across the interval of the upper surfaces of the two detectable members 81A and 81B. Here, the widthwise shift detection means 35, that is, the two proximity sensors 35*a* and 35*b*, are deployed to detect one of the detectable members, namely 81A.

According to this third embodiment, as the non-driven travel wheel 83 turns between the upper surfaces of the two detectable members 81A and 81B, the two proximity sensors 35*a* and 35*b* can be opposed to the detectable member 81A, always at a constant interval, whereby the detection by the two proximity sensors 35*a* and 35*b* can be made accurately.

[Fourth Embodiment]

Figure 14:
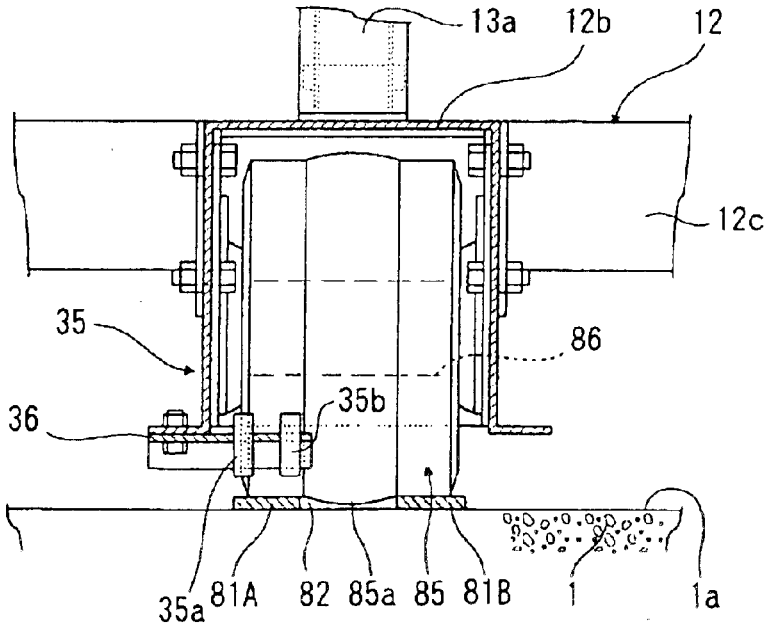
FIG. 14 is a longitudinal sectional front elevation of a movable rack widthwise shift detection means in a movable rack system according to a fourth embodiment of the present invention.

Next, a fourth embodiment of the present invention is described with reference to FIG. 14.

Specifically, a pair of detectable members 81A and 81B are laid down on the floor surface 1*a* with a gap 82 therebetween in the transverse direction B to the travel path 10. Also, a non-driven travel wheel 85 (being one example of a non-driven travel support device) made of a metal such as steel is provided via a wheel shaft 86. The non-driven travel wheel 85 is placed to span across the interval of the upper surfaces of the two detectable members 81A and 81B. Here, a rib 85*a* that is engaged in the gap 82 is formed in the non-driven travel wheel 85.

According to this fourth embodiment, as the non-driven travel wheel 85 turns between the upper surfaces of the two detectable members 81A and 81B, the two proximity sensors 35*a* and 35*b* can be opposed to the detectable members 81A and 81B, always at a constant interval, whereby the detection by the two proximity sensors 35*a* and 35*b* can be made accurately. Furthermore, with the rib 85*a* engaged in the gap 82, it is made difficult for the non-driven travel wheel 85 to diverge from the two detectable members 81A and 81B, that is, widthwise shifts of the wheel can hardly occur.

[Fifth Embodiment]

Figure 15:
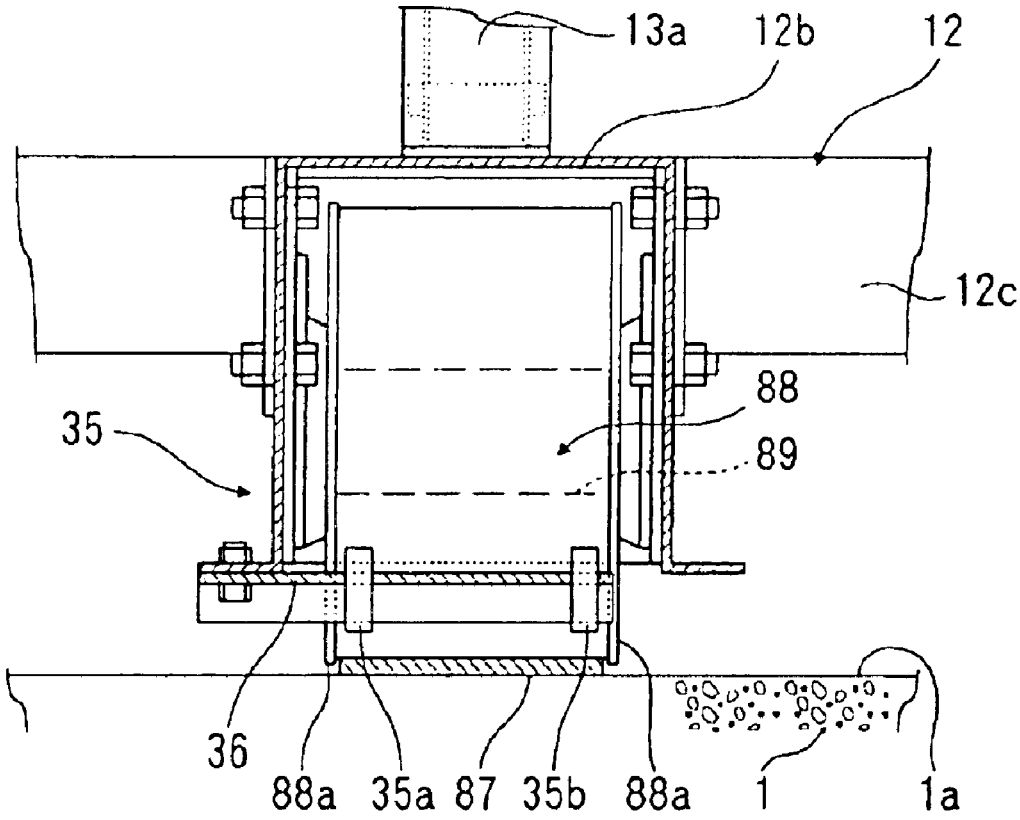
FIG. 15 is a longitudinal sectional front elevation of a movable rack widthwise shift detection means in a movable rack system according to a fifth embodiment of the present invention.

Next, a fifth embodiment of the present invention is described with reference to FIG. 15.

Specifically, one detectable member 87 is laid down on the floor surface 1*a* along the travel path direction A, a non-driven travel wheel (being one example of a non-driven travel support device) 88 made of a metal such as steel is provided via a wheel shaft 89, and the non-driven travel wheel 88 is placed on the detectable member 87. Here, a pair of ribs 88*a* that are engaged from the outside with the two side edges of the detectable member 87 are formed in the non-driven travel wheel 88.

According to this fifth embodiment, as the non-driven travel wheel 88 turns on the two detectable members 87, the two proximity sensors 35*a* and 35*b* can oppose the detectable member 87, always at a constant interval, whereby the detection by the two proximity sensors 35*a* and 35*b* can be made accurately. Furthermore, with the ribs 88*a* engaged with the two side edges of the detectable member 87 from the outside, it is made difficult for the non-driven travel wheel 88 to diverge from the two detectable members 87, that is, widthwise shifts of the wheel can hardly occur. In addition, the accuracy of detection can be raised by installing the two proximity sensors 35*a* and 35*b* at sufficiently distant positions by effectively utilizing the entire width of the broad-width detectable member 87.

[Sixth Embodiment]

Next, a sixth embodiment of the present invention is described with reference to FIG. 16.

In the first to fifth embodiments described in the foregoing, the driven travel wheels 14A deployed in the opposite outside portions in the transverse direction B are provided at two places at diagonally opposing positions relative to the rectangular frame shaped lower frame unit 12, the motors 16 respectively equipped with speed reducers are connected in linkage with the two drive wheel shafts 15A, and the pulse encoders 21 are deployed near those driven travel wheels 14A, but such deployments and numbers can be freely modified.

Figure 16A:
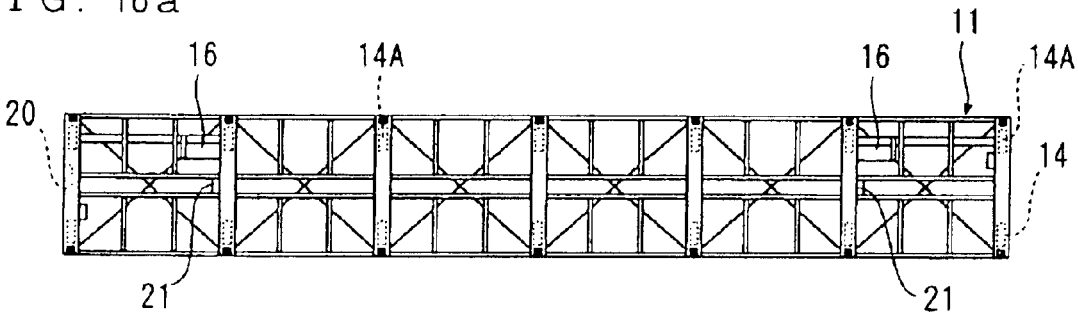
FIG. 16*a* to FIG. 16*d* are plans each showing a movable rack in a movable rack system according to a sixth embodiment of the present invention.
Figure 16B:
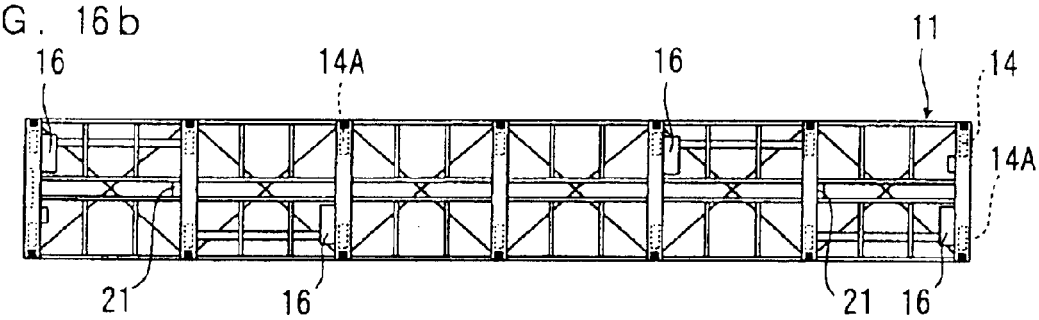
Figure 16C:
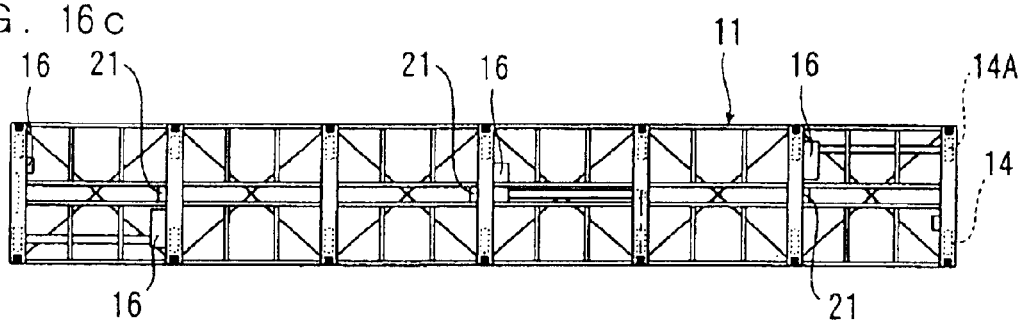
Figure 16D:
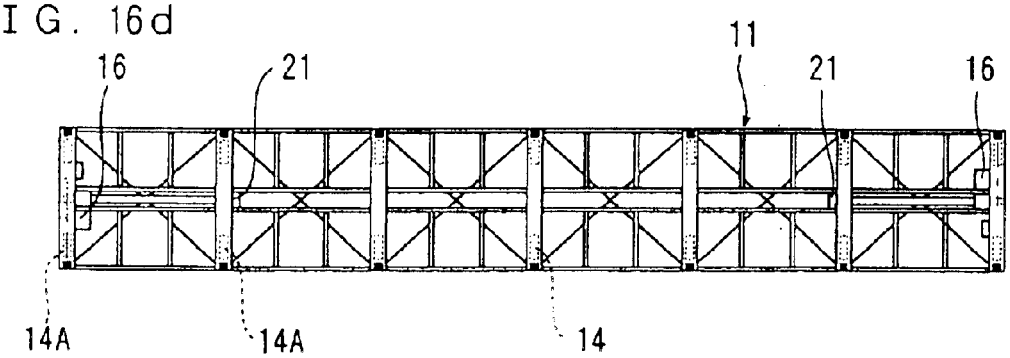

Specifically, in FIG. 16*a*, the driven travel wheels 14A and the like are positioned on an identical line in the transverse direction B. In FIG. 16*b*, however, the driven travel wheels 14A and the like are positioned at four places corresponding to the corners. In FIG. 16*c*, the driven travel wheel 14A or the like is added at one place in the center portion. And in FIG. 16*d*, a pair of motors 16 or the like are deployed in the center portion.

In this sixth embodiment, an optimal drive configuration can be adopted in correspondence to the size of the movable racks 11 or the loads of the handling goods or the like.

In the first to sixth embodiments described in the foregoing, goods are placed or accommodated in accommodating section spaces 13*e* in the movable racks 11 or accommodating section spaces 5*a* in the stationary racks 3, by using pallets, but the configuration may be such that box containers are placed and accommodated.

In the first to sixth embodiments described in the foregoing, moreover, the movable racks 11 and stationary racks 3 have been shown as comprising the lower frame units 12 and 4, and rack units 13 and 2, but they may be dolly type racks with no rack units 13 or 5, and table type stationary racks 3.

In the first to sixth embodiments described in the foregoing, moreover, the movable racks 11 and stationary racks 3 have been shown as having the accommodating section spaces 13*e* and 5*a* at the uppermost level, which are open upward. These may be, alternatively, movable racks 11 or stationary racks 3 that have roof units at the tops thereof.

In the first to sixth embodiments described in the foregoing, moreover, in deploying the detectable members 31, 81A, 81B, and 87, the detectable members 31, 81A, 81B, and 87 are laid on the floor surface 1*a*, but they may be alternatively positioned inside channels formed in the floor 1, with a portion or the entirety thereof buried. In this case, the crossing over by the vehicles can be further facilitated.

In the first to sixth embodiments described in the foregoing, moreover, one pair of (i.e. two) driven travel wheels 14A are driven by motors 16, but the configuration may be such that one driven travel wheel 14A is driven by the motor 16, or, alternatively, a speed reducer is directly connected to one end of the drive shaft of one driven travel wheel 14A and the motor 16 is directly connected to the speed reducer to effect direct driving of the wheel or wheels.

In the first to sixth embodiments described in the foregoing, moreover, a drive wheel type is presented for the drive support device, but that may be a roller chain type (caterpillar type) or the like. In this case, the roller chains or the like are arranged along the entire length in the travel path direction A, either singly or in divided plural number, respectively at the opposite outside portions of the movable rack 11 in the transverse direction B.

In the first to sixth embodiments described in the foregoing, moreover, a two-set detection type is indicated, in which pulse encoders 21 are adopted as the travel amount detection means, outer slits 28*a* and inner slits 28*b* are formed in the turning unit 28, a photoelectric switch 29*a* is disposed to oppose the outer slits 28*a*, and a photoelectric switch 29*b* is disposed to oppose the inner slits 28*b*. This, however, may alternatively be a single-set detection type or a plural-set detection type having two or more sets of detection means.

In the first to sixth embodiments described in the foregoing, moreover, the pulse encoders 21 having the detection wheel unit 27 and the like are indicated as the travel amount detection means, but it may alternatively be of a type that measures drive rotation amounts in a driven travel support device, or the like. The pulse encoder 21 is made to detect the turning of the detection wheel unit 27, but it may alternatively be linked to the turning shaft of the induction type motors 16 (an example of rotation drive means) to detect the travel amounts of the movable rack 11.

In the first to sixth embodiments described in the foregoing, a sheet rail is adopted as the detectable member 31, and a pair of proximity sensors 35*a* and 35*b* are adopted as the widthwise shift detection means 35. However, this widthwise shift detection may be of a type that comprises an inductor (induction line) and a pickup coil. Also, the movable rack widthwise shift correcting control is performed to eliminate differences in the data detected by the proximity sensors 35*a* and 35*b*. The movable rack widthwise shift correcting control may alternatively be performed by keeping the data detected by the proximity sensors 35*a* and 35*b* not to diverge from set values, or, to correct the data if the same diverges, to find speed command values for the driven travel wheels 14A, thereby performing the control. It is also possible, for the widthwise shift detection means 35, to comprise switches for detecting the detectable members 31 (i.e. switches that turn on when a detectable member 31 is detected), respectively, on the two ends of the detectable members 31 in the transverse direction, and to perform the movable rack widthwise shift correcting control by turning on both of the switches. The widthwise shift detection means 35 may comprise a plurality of regressive reflecting type photosensors on the front and rear surfaces of the movable rack 11, in a fashion to oppose the movable rack 11, to perform the movable rack widthwise shift correcting control as the photosensors are made to turn off when the movable racks 11 become mutually shifted. Alternatively, the pair of proximity sensors 35*a* and 35*b* may be further added with a pair of proximity sensors, to detect the widthwise shifts by these total four sensors.

In the first to sixth embodiments described in the foregoing, in effecting a simultaneous travel of a plural number of movable racks 11, the racks are activated (started) sequentially at a set time interval, but the plural number of movable racks 11 may also be activated (started) simultaneously.

In the first to sixth embodiments described in the foregoing, the detectable member is positioned within the width of the movable rack 11, but the detectable member may also be positioned outside the width of the movable rack 11.

What is claimed is:

1. A movable rack system comprising a plurality of movable racks that travel freely back and forth along a travel path while being supported by a plurality of travel support devices, wherein out of the plurality of travel support devices, two travel support devices are positioned in opposite outside portions in a traverse direction to the travel path, each of the travel support devices including a rotation drive means, each of the travel support devices being a driven travel support device; and each of the movable racks includes travel amount detection means respectively detecting travel amounts of the driven travel support devices positioned in the opposite outside portions, and a control means for controlling drive rotation amounts of the rotation drive means, based on detection results by the travel amount detection means;

the control means performing a movable rack attitude correcting control by finding predicted values for the travel amounts of the driven travel support devices respectively detected by the travel amount detection means, based on a time period elapsed immediately after the movable rack started traveling until the deviation between the travel amounts of the two driven travel support devices exceeds a prescribed travel amount, and on subsequent travel amounts of the driven travel support devices, when the deviation in the travel amounts of the driven travel support devices exceeds the prescribed travel amount, so that the drive rotation amounts of the rotation drive means are correctively controlled to eliminate the deviation between the predicted values.

2. The movable rack system according to claim 1, wherein the control means controls the rotation drive means linked to the driven travel support device on a side where the travel amount is larger, to reduce the drive rotation amount of the rotation drive means.

3. The movable rack system according to claim 1, wherein as from a time when the deviation between travel amounts of the two driven travel support devices has exceeded a prescribed travel amount, the control means starts finding predicted values expected to stand after an elapse of a set time after a present actual time, and performs the movable rack attitude correcting control.

4. The movable rack system according to claim 1, wherein the control means correctively controls the drive rotation amounts of the rotation drive means to eliminate the deviation between travel amounts of the two driven travel support devices until the deviation exceeds a prescribed travel amount.

5. The movable rack system according to claim 1, wherein the control means performs the movable rack attitude correcting control, and, when the deviation between the predicted values becomes substantially zero, performs the corrective control of the drive rotation amounts of the rotation drive means to eliminate the deviation between travel amounts of the two driven travel support devices.

6. The movable rack system according to claim 1, wherein when the plurality of movable racks are made to travel, sequential travel command outputs are input, at set time intervals, to the control means of the movable racks.

7. The movable rack system according to claim 1, wherein the travel amount detection means is a pulse encoder provided in the vicinity of the driven travel support device.

8. The movable rack system according to claim 7, wherein the control means performs the movable rack attitude correcting control when difference in count of pulses output from the pulse encoders of the two driven travel support devices exceeds a pulse count, of which setting can be altered.

9. A movable rack system comprising a plurality of movable racks that travel freely back and forth alone a travel path while being supported by a plurality of travel support devices, wherein out of the plurality of travel support devices, two travel support devices are positioned in opposite outside portions in a traverse direction to the travel path, each of the travel support devices including a rotation drive means, each of the travel support devices being a driven travel support device;

a detectable member provided on a floor along the travel path, the detectable member allowing a vehicle to ride thereover;

each of the movable racks includes travel amount detection means respectively detecting travel amounts of the driven travel support devices positioned in the opposite outside portions, a widthwise shift detection means for detecting a shift of the movable rack in the transverse direction to the travel path by detecting the detectable member and a control means for controlling drive rotation amounts of the rotation drive means, based on detection results by the travel amount detection means and the widthwise shift detection means;

the control means performing a movable rack attitude correcting control by using predicted values of the travel amounts of the driven travel support devices, when a deviation occurs in the travel amounts of the driven travel support devices respectively detected by the travel amount detection means, so that the drive rotation amounts of the rotation drive means are correctively controlled to eliminate the deviation between the predicted values, and further performing a movable rack widthwise shift correcting control to control the rotation drive means so that a value detected by the widthwise shift detection means does not diverge from a set value.

10. The movable rack system according to claim 9, wherein the control means performs the movable rack widthwise shift correcting control with priority over the movable rack attitude correcting control.

11. The movable rack system according to claim 9, wherein the detectable member is disposed between the two driven travel support devices positioned in the opposite outside portions, and along the travel path on a central portion of the floor.

12. A movable rack system comprising a plurality of movable racks that travel freely back and forth alone a travel path while being supported by a plurality of travel support devices, wherein out of the plurality of travel support devices, two travel support devices are positioned in opposite outside portions in a traverse direction to the travel path, each of the travel support devices including a rotation drive means, each of the travel support devices being a driven travel support device;

each of the movable racks includes travel amount detection means respectively detecting travel amounts of the driven travel support devices positioned in the opposite outside portions, and a control means for controlling drive rotation amounts of the rotation drive means, based on detection results by the travel amount detection means;

a vector control inverter is used in the rotation drive means; and the control means performing a movable rack attitude correcting control by using predicted values of the travel amounts of the driven travel support devices, when a deviation occurs in the travel amounts of the driven travel support devices respectively detected by the travel amount detection means, so that the drive rotation amounts of the rotation drive means are correctively controlled to eliminate the deviation between the predicted values.

13. A movable rack system comprising a plurality of movable racks that travel freely back and forth along a travel path while being supported by a plurality of travel support devices, wherein out of the plurality of travel support devices, two travel support devices are positioned in opposite outside portions in a traverse direction to the travel path, each of the travel support devices including a rotation drive means, each of the travel support devices being a driven travel support device;

a detectable member allowing a vehicle to ride thereover is provided on a floor along the travel path; and each of the movable racks includes travel amount detection means respectively detecting travel amounts of the driven travel support devices in the opposite outside portions;

a widthwise shift detection means provided in the movable rack, the widthwise shift detection means detecting a shift of the movable rack in the transverse direction to the travel path by detecting the detectable member; and a control means for controlling drive rotation amounts of the rotation drive means, based on the travel amounts of the driven travel support devices respectively detected by the travel amount detection means, performing a corrective control of the drive rotation amounts of the rotation drive means to eliminate a deviation between these travel amounts, and performing a movable rack widthwise shift correcting control for controlling the or each rotation drive means so that a value detected by the widthwise shift detection means does not diverge from a set value.

14. The movable rack system according to claim 13, wherein the control means controls the rotation drive means linked to the driven travel support device on a side where the travel amount is larger, to reduce the drive rotation amount thereof.

15. The movable rack system according to claim 13, wherein when a deviation between the travel amounts of the driven travel support devices respectively detected by the travel amount detection devices exceeds a prescribed travel amount, the control means operates:

to find predicted values for the travel amounts of the driven travel support devices, based on a time period elapsed immediately after the movable rack started traveling until the deviation between the travel amounts of the two driven travel support devices exceeds a prescribed travel amount, and on subsequent travel amounts of the driven travel support devices; and to perform a movable rack attitude correcting control to correctively control drive rotation amounts of the rotation drive means, to eliminate the deviation between the predicted values.

16. The movable rack system according to claim 15, wherein as from a time when the deviation between the travel amounts of the two driven travel support devices has exceeded a prescribed travel amount, the control means starts finding predicted values expected to stand after an elapse of a set time after a present actual time, and performs the movable rack attitude correcting control.

17. The movable rack system according to claim 15, wherein the control means correctively controls drive rotation amounts of the rotation drive means to eliminate the deviation between the travel amounts of the two driven travel support devices, until the deviation between the travel amounts exceeds a prescribed travel amount.

18. The movable rack system according to claim 15, wherein the control means performs the movable rack attitude correcting control, and, when a deviation between the predicted amounts becomes substantially zero, the control means correctively controls drive rotation amounts of the rotation drive means to eliminate the deviation between the travel amounts of the two driven travel support devices.

19. The movable rack system according to claim 15, wherein the control means performs the movable rack widthwise shift correcting control with priority over the movable rack attitude correcting control.

20. The movable rack system according to claim 13, wherein when the plurality of movable racks are made to travel, sequential travel command outputs are input, at set time intervals, to the control means of the movable racks.

21. The movable rack system according to claim 13, wherein a vector control inverter is used in the rotation drive means.

22. The movable rack system according to claim 13, wherein the travel amount detection means are pulse encoders provided in the vicinity of the driven travel support devices.

23. The movable rack system according to claim 22, wherein the control means performs the movable rack attitude correcting control when difference in count of pulses output from the pulse encoders of the two driven travel support devices exceeds a pulse count, of which setting can be altered.

* * * * *